US007328983B2

(12) United States Patent
Kaga

(10) Patent No.: US 7,328,983 B2
(45) Date of Patent: Feb. 12, 2008

(54) INK-JET PRINTER AND METHOD OF CONTROLLING INK-JET PRINTER

(75) Inventor: Hikaru Kaga, Aisai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 11/419,983

(22) Filed: May 23, 2006

(65) Prior Publication Data

US 2006/0268076 A1 Nov. 30, 2006

(30) Foreign Application Priority Data

May 24, 2005 (JP) ..... 2005-150535

(51) Int. Cl.
*B41J 2/125* (2006.01)

(52) U.S. Cl. ..... 347/81

(58) Field of Classification Search ..... 347/89, 347/87, 86, 85, 84, 30, 24, 5–6
See application file for complete search history.

(56) References Cited

U.S. PATENT DOCUMENTS 4,399,446 A * 8/1983 McCann et al. ..... 347/89
5,126,766 A * 6/1992 Terasawa et al. ..... 347/30
6,318,850 B1 * 11/2001 Childers et al. ..... 347/85
6,447,109 B1 * 9/2002 Williamson et al. ..... 347/85
2004/0196326 A1 10/2004 Sasa

FOREIGN PATENT DOCUMENTS

JP 2004 58348 2/2004

* cited by examiner

*Primary Examiner*—K. Feggins
(74) *Attorney, Agent, or Firm*—Baker Botts L.L.P.

(57) ABSTRACT

An ink-jet printer, including an ink-jet recording head having an ink inflow passage including an ink inlet, and an air-discharge passage which allows the ink inflow passage to communicate with an atmosphere; an air-discharge valve which selectively opens and closes the air-discharge passage; an ink tank which stores the ink and which has an ink outlet and an air inlet; a connector having an ink supply passage which communicates, at one end thereof, with the ink outlet of the ink tank and communicates, at an other end thereof, with the ink inlet of the recording head; an air supplying device which supplies the air to the ink tank via the air inlet thereof; an obtaining portion which obtains one of an elapsed time, t, from a reference time, and a volume, V, of an air present in the ink supply passage and the ink inflow passage at the elapsed time t, based on an other of the elapsed time t and the air volume V, and a following relationship: $V=a\cdot e^{bt}$, where a and b are coefficients and e is a base of a natural logarithm; and a control portion which controls, based on the obtained one of the elapsed time t and the air volume V, an operation of the air supplying device and/or the air-discharge valve, so that the volume V of the air at the elapsed time t is discharged through the air-discharge passage opened by the air-discharge valve.

24 Claims, 20 Drawing Sheets

INK-JET PRINTER AND METHOD OF CONTROLLING INK-JET PRINTER

The present application is based on Japanese Patent Application No. 2005-150535 filed on May 24, 2005, the contents of which are incorporated herein by reference.

BACKGROUND OF THE INVENTION

1. Field of the Invention

The present invention relates to an ink-jet printer that ejects droplets of ink onto a recording medium, and a method of controlling an ink-jet printer.

2. Discussion of Related Art

There is known an ink-jet printer including an ink-jet recording head that ejects droplets of ink; an ink tank that stores an ink to be supplied to the recording head via a flexible ink-supply tube; and an air tank that stores air to be supplied to the ink tank. An example of this ink-jet printer is disclosed by Japanese Patent Application Publication No. 2004-58348 or its corresponding U.S. Patent Application Publication No. 2004/0196326A1. This ink-jet printer has such a problem that air enters the flexible ink-supply tube through its wall and, as time elapses, air bubbles grow and increase in the ink-supply tube and eventually lower an ink-ejecting performance of the ink-jet recording head. To solve this problem, the ink-jet printer periodically carries out an air discharging operation in which air is quickly supplied from the air tank to the ink tank so as to discharge forcibly the air bubbles, together with an amount of the ink, from the ink-supply tube into an outside space.

SUMMARY OF THE INVENTION

However, in the above-indicated ink-jet printer, each air discharging operation is so performed as to discharge a predetermined amount of ink, irrespective of what amount of air (i.e., air bubbles) may be present in the ink-supply tube, e.g., at a time immediately before each printing or recording operation is started. If the air discharging operation is so performed as to discharge completely the air present in the ink-supply tube even if the total amount of the air may be large, then a large amount of the ink must be discharged together with the air, i.e., the large amount of ink is consumed uselessly. On the other hand, if the air discharging operation is so performed as to discharge only a small amount of the ink, then only an insufficient amount of the air may be discharged, which may lead to lowering the ink-ejecting performance of the ink-jet recording head.

It is therefore an object of the present invention to solve at least one of the above-indicated problems. It is another object of the present invention to provide an ink-jet printer and an ink-jet-printer controlling method each of which assures that a high ink-ejecting performance of the printer is maintained and, when an air discharging operation is carried out, useless consumption of ink is effectively prevented.

The Inventor has carried out extensive studies and found that an amount of air present in an ink-supply passage and an ink inflow passage can be expressed by an exponential function of an elapsed time, t, from a reference time, t=0 (the elapsed time t is a variable). The reference time may be a time when the last air discharging operation is carried out to discharge, through an air-discharge passage, the air present in the ink-supply passage and the ink inflow passage. The present invention has been developed based on this finding.

The above objects may be achieved according to the present invention. According to a first aspect of the present invention, there is provided an ink jet printer, comprising an ink-jet recording head having (a) an ink inflow passage including an ink inlet into which an ink inflows, and (b) an air-discharge passage which allows the ink inflow passage to communicate with an atmosphere; an air-discharge valve which selectively opens and closes the air-discharge passage; an ink tank which stores the ink and which has (c) an ink outlet from which the ink outflows and (d) an air inlet into which an air inflows; a first connector having an ink supply passage which communicates, at one end thereof, with the ink outlet of the ink tank and communicates, at an other end thereof, with the ink inlet of the ink-jet recording head; an air supplying device which supplies the air to the ink tank via the air inlet thereof, an obtaining portion which obtains one of (e) an elapsed time, t, from a reference time and (f) a volume, V, of an air present in the ink supply passage and the ink inflow passage at the elapsed time t, based on an other of the elapsed time t and the volume V of the air, and a following relationship:

$$V=a\cdot e^{bt}$$

where a and b are coefficients, and e is a base of a natural logarithm; and a control portion which controls, based on the obtained one of the elapsed time t and the volume V of the air, an operation of at least one of the air supplying device and the air-discharge valve, so that the volume V of the air at the elapsed time t is discharged through the air-discharge passage opened by the air-discharge valve.

According to a second aspect of the present invention, there is provided a method of controlling an ink-jet printer including an ink-jet recording head having (a) an ink inflow passage including an ink inlet into which an ink inflows, and (b) an air-discharge passage which allows the ink inflow passage to communicate with an atmosphere; an air-discharge valve which selectively opens and closes the air-discharge passage; an ink tank which stores the ink and which has (c) an ink outlet from which the ink outflows and (d) an air inlet into which an air inflows, a connector having an ink supply passage which communicates, at one end thereof, with the ink outlet of the ink tank and communicates, at an other end thereof; with the ink inlet of the ink-jet recording head; and an air supplying device which supplies the air to the ink tank via the air inlet thereof, the method comprising obtaining one of (e) an elapsed time, t, from a reference time and (f) a volume, V, of an air present in the ink supply passage and the ink inflow passage at the elapsed time t, based on an other of the elapsed time t and the volume V of the air, and a following relationship:

$$V=a\cdot e^{bt}$$

where a and b are coefficients, and e is a base of a natural logarithm, and controlling, based on the obtained one of the elapsed time t and the volume V of the air, an operation of at least one of the air supplying device and the air-discharge valve, so that the volume V of the air at the elapsed time t is discharged through the air-discharge passage opened by the air-discharge valve.

In the above-indicated ink-jet printer or the above-indicated ink-jet-printer controlling method, the amount V of the air or the elapsed time t can be accurately obtained, and the air supplying device and/or the air-discharge valve are/is controlled based on the obtained air amount V or the obtained elapsed time t. Therefore, a high ink-ejecting performance of the ink-jet printer can be maintained and, when an air discharging operation is carried out, useless consumption of the ink can be effectively prevented.

In the case where the air supplying device is controlled based on the obtained air amount V or elapsed time t, an operation speed at which the device is operated and/or an operation time period in which the device is kept operated may be determined based the same V, t. In the case where the air-discharge valve is controlled based on the obtained air amount V or elapsed time t, an open-state time period in which the air-discharge valve is kept opened, and/or a timing when the air-discharge valve is opened may be determined based the same V, t. The operation time period of the air supplying device and the open-state time period of the air-discharge valve may be determined to be equal to each other.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENTS

Hereinafter, there will be described preferred embodiments of the present invention by reference to the drawings.

First Embodiment

Figure 1:
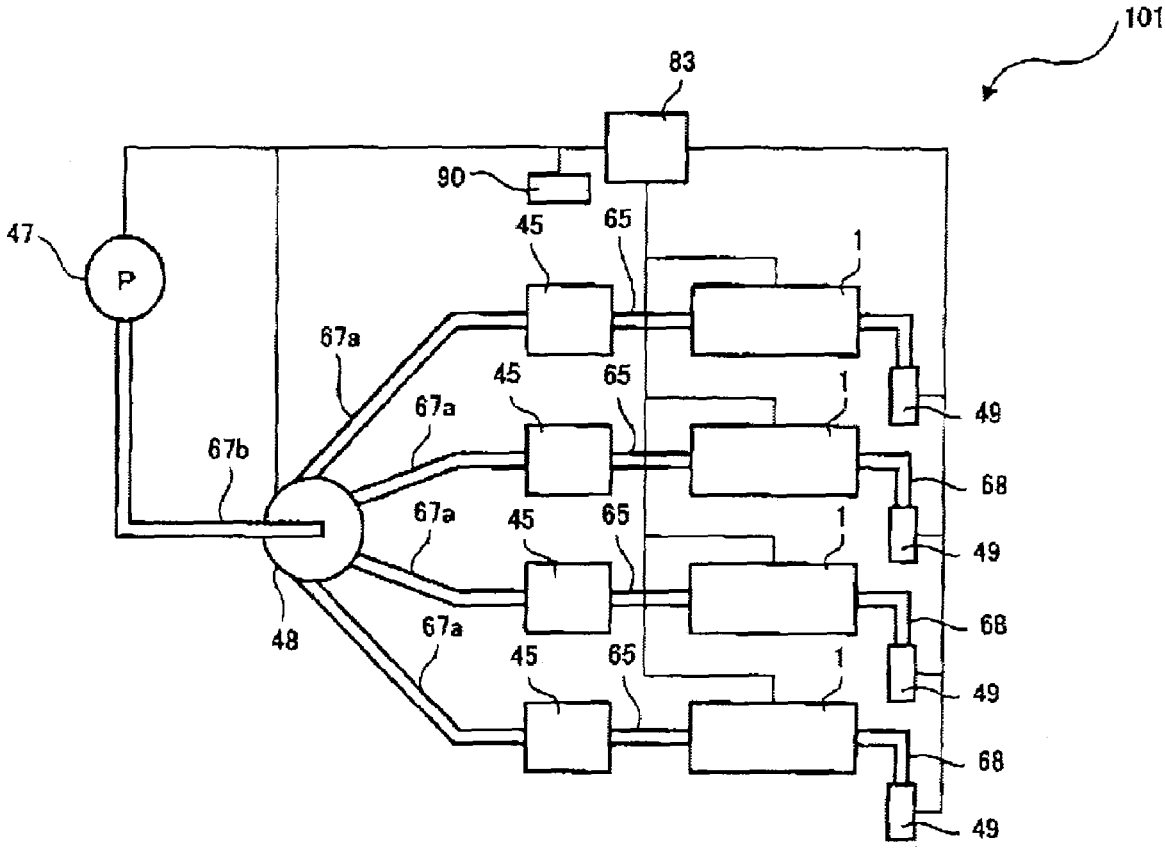
FIG. 1 is a schematic view of an ink-jet printer to which the present invention is applied.

FIG. 1 schematically shows a construction of an ink-jet printer 101 as a first embodiment of the present invention. The ink-jet printer 101 is for recording a desired image on a recording medium, e.g., a recording sheet, by ejecting droplets of ink onto the sheet. As shown in FIG. 1, the ink-jet printer 101 includes four ink-jet recording heads 1; four ink tanks 45 corresponding to the four ink-jet heads 1, respectively; an air pump 47; a switching unit (i.e., an air valve) 48; an air-discharge valve 49; and a control device 83.

Each ink-jet recording head 1 is a serial-type recording head that ejects droplets of ink onto the recording sheet while being moved in a main scan direction perpendicular to a sub-scan direction in which the recording sheet is fed by a feeding device, not shown. The four ink-jet heads 1 are configured such that the four heads 1 eject droplets of four different inks, respectively. The four different inks are a cyan ink, a yellow ink, a magenta ink, and a black ink. Thus, the ink-jet printer 101 prints or records a full-color image on a recording sheet.

Figure 2:
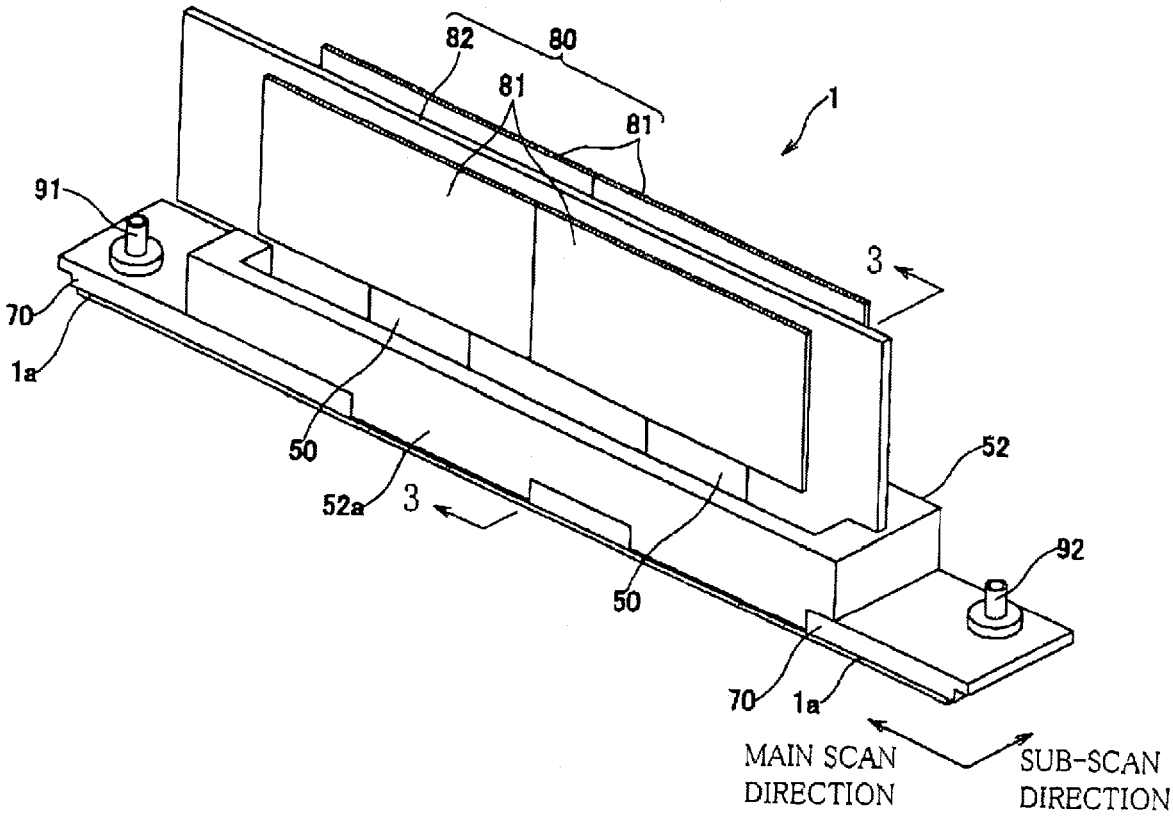
FIG. 2 is a perspective view of an ink-jet recording head of the printer of FIG. 1.
Figure 3:
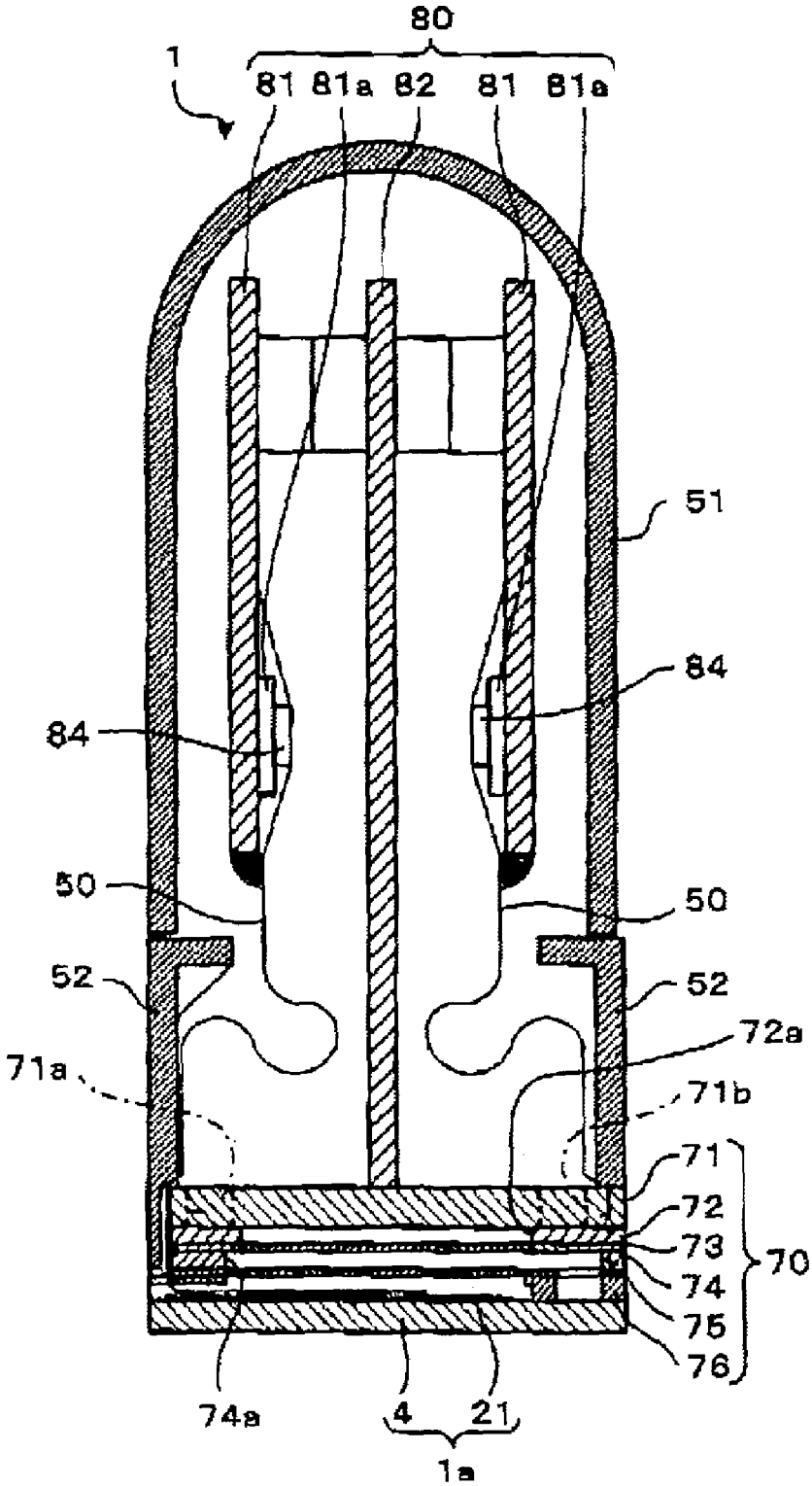
FIG. 3 is a cross-sectional view of the ink-jet recording head, taken along 3-3 in FIG. 2.

Hereinafter, each ink-jet head 1 will be described in detail by reference to FIGS. 2 and 3. As shown in those figures, the ink-jet head 1 has a shape elongate in the main scan direction, and includes a main portion 1*a*, a reservoir unit 70, and a control portion 80 that controls an operation of the main portion 1*a*.

The control portion 80 controls the ink-jet head 1 based on commands supplied thereto from the control device 83. The control portion 80 includes a main substrate 82; four auxiliary substrates 81 two of which are provided on one side of the main substrate 82 and the other two of which are provided on the other side of the same 82; and four driver ICs (integrated circuits) 81*a* that are fixed to respective inner surfaces of the four auxiliary substrates 81 that are opposed to the main substrate 82. The main portion 1*a* of each ink-jet head 1 includes four actuator units 21. The four driver ICs 81*a* produce respective drive signals to drive the four actuator units 21. Four heat sine 84 are fixed to respective surfaces of the four driver ICs 81*a* that are opposed to the main substrate 82.

Four FPCs (flexible printed circuits) 50 each as a power-supply element are connected, at respective one ends thereof, to the four actuator units 21, and are connected, at the respective other ends thereof to the four auxiliary substrates 81, respectively. In addition, the four FPCs 50 are also connected, midway between the four actuator units 21 and the four auxiliary substrates 81, to the four driver ICs 81*a*, respectively. That is, the four FPCs 50 are electrically connected to the four auxiliary substrates 81 and the four driver ICs 81*a*, and transmit respective signals outputted from the four auxiliary substrates 81, to the four driver ICs 81*a*, and supplies the respective drive signals outputted from the four driver ICs 81*a*, to the four actuator units 21.

The ink-jet head 1 further includes an upper cover 51 that covers the control portion 80; and a lower cover 52 that covers a lower portion of the head 1. The upper cover 51 has an arched ceiling, and covers the control portion 80. The lower cover 52 has a generally rectangular tubular shape with an upper open end and a lower open end, and covers the lower portion of the main substrate 82. The upper and lower covers 51, 52 cooperate with each other to prevent ink scattered in a printing operation, from adhering to, e.g., the control portion 80. In FIG. 2, the upper cover 51 is removed from the ink-jet head 1, just for allowing the control portion 80 to be seen.

Figure 4:
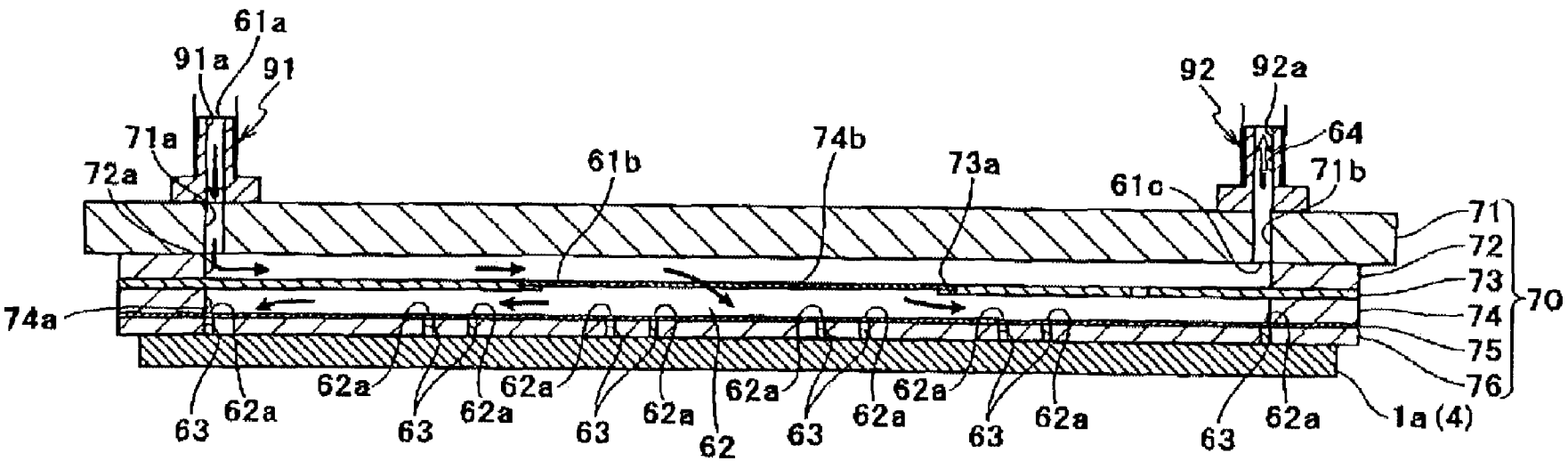
FIG. 4 is a cross-sectional view of a reservoir unit and a main portion of the ink-jet recording head, taken in a main scan direction.

Next, the reservoir unit 70 will be described by reference to FIG. 4, i.e., a cross-sectional view taken along a plane parallel to the main scan direction. However, it is noted that in FIG. 4, a degree of contraction of scale with respect a vertical direction is smaller than that with respect to a horizontal direction, for easier understanding purposes only. In addition, FIG. 4 shows different sorts of ink flow passages that cannot be seen in a cross-sectional view taken along a single plane.

The reservoir unit 70 is for temporarily storing the ink, and supplies it to the main portion 1*a*. As shown in FIG. 4, the reservoir unit 70 has a stacked structure in which six plate members 71, 72, 73, 74, 75, 76 each of which has a rectangular flat shape elongate in the main scan direction (FIG. 2) are stacked on each other. The reservoir unit 70 has an ink inflow passage 61, an ink reservoir 62, a plurality of ink introduction passages 63, and an air-discharge passage 64. A first joint 91 is fixed to one of lengthwise opposite end portions of an upper surface of the reservoir unit 70, and a second joint 92 is fixed to the other end portion of the upper surface of the reservoir unit 70. A first cylindrical space 91*a* and a second cylindrical space 92*a* are formed in the first and second joints 91, 92, respectively. An ink supply tube 65 having an ink supply passage therein is connected to the first joint 91; and an air-discharge tube 68 is connected to the second joint 92. The ink supply tube 65 corresponds to a first connector having an ink supply passage.

The ink supplied from the ink tank 45 flows into the ink inflow passage 61 via the ink supply tube 65. The ink inflow passage 61 includes the cylindrical space 91*a*; a through hole 71*a* that is formed through the thickness of the plate member 71 such that the through hole 71 is aligned with the cylindrical space 91*a*; and an opening 72*a* that is formed through the thickness of the plate member 72 such that the opening 72*a* extends from one end portion of the member 72 that is opposed to the first cylindrical space 91*a*, to the other end portion of the same 72 that is opposed to the second cylindrical space 92*a*. In addition, an upper open end of the first cylindrical space 91*a* constitutes an ink inlet 61*a*. An opening 73*a* is formed through the thickness of the plate member 73, and constitutes a reservoir communication opening 61*b* of the ink inflow passage 61. An air-discharge-valve communication hole 61*c* is defined by a through hole 71*b* that is formed through the thickness of the plate member 71 such that the through hole 71*b* is aligned with the second cylindrical space 92*a*.

The reservoir 62 is for temporarily storing the ink flowing from the ink inflow passage 61 through the reservoir communication opening 61*b* thereof, and includes an opening 74*a* that is formed through the thickness of the plate member 74 such that the opening 74*a* extends from one end portion of the member 74 that is opposed to the first cylindrical space 91*a*, to the other end portion of the same 74 that is opposed to the second cylindrical space 92*a*. A plurality of holes are formed through the thickness of the plate member 75, and constitute a plurality of introduction-passage communication holes 62*a* through which the reservoir 62 communicates with the plurality of ink introduction passages 63, respectively. The opening 73*a* has, along a periphery thereof, a stepped portion or surface that supports a filter member 74*b* that removes dust from the ink.

The ink introduction passages 63 are for supplying the ink stored in the reservoir 62, to the main portion 1*a*, and are formed in the plate member 76 such that the ink introduction passages 63 are aligned with the introduction-passage communication holes 62*a* of the plate member 75. The ink introduction passages 63 communicate, at respective one ends thereof, with the introduction-passage communication holes 62*a*, and communicate, at the respective other ends thereof, with a plurality of ink supply ports 5*b* (FIG. 5) opening in an upper surface of a flow-channel unit 4 (described later) of the main portion 1*a*.

The air-discharge passage 64 is for discharging, into an ambient space, air produced in the ink supply tube 65 and the ink inflow passage 61, and includes the second cylindrical space 92*a*, and the air-discharge valve communication hole 61*c* (hole 71*b*) formed in the plate member 71 to be aligned with the second cylindrical space 92*a*. The air-discharge passage 64 communicates with the ink inflow passage 61 via the air-discharge-valve communication hole 61*c*, and additionally communicates with the air-discharge tube 68.

Next, how the ink flows in the reservoir unit 70 will be described. As indicated by arrows in FIG. 4, first, the ink flows, through the ink inlet 61*a*, into the ink inflow passage 61, and then flows, through the reservoir communication opening 61*b*, into the reservoir 62. In addition, the ink flows, through the introduction-passage communication opening 62*a*, into the ink introduction passages 63. Then, the ink flows from the ink introduction passages 63 to the flow-channel unit 4 of the main portion 1*a* via the ink supply ports 5*b*.

As will be described later, when an air discharging operation is carried out in a state in which the air-discharge tube 68 is in communication with the atmosphere, the ink flowing in the ink inflow passage 61 is caused, because of a lower flow resistance, to flow into the air-discharge passage 64 via the air-discharge-valve communication hole 61*c*, so that the ink is discharged from the air-discharge tube 68 into the ambient space. Thus, air bubbles present in the ink supply tube 65 and the ink inflow passage 61, the ink (i.e., deteriorated ink) whose properties have changed (e.g., its viscosity has increased), and foreign matters that have been captured by the filter 74*b* are discharged through the air-discharge tube 68.

Figure 5:
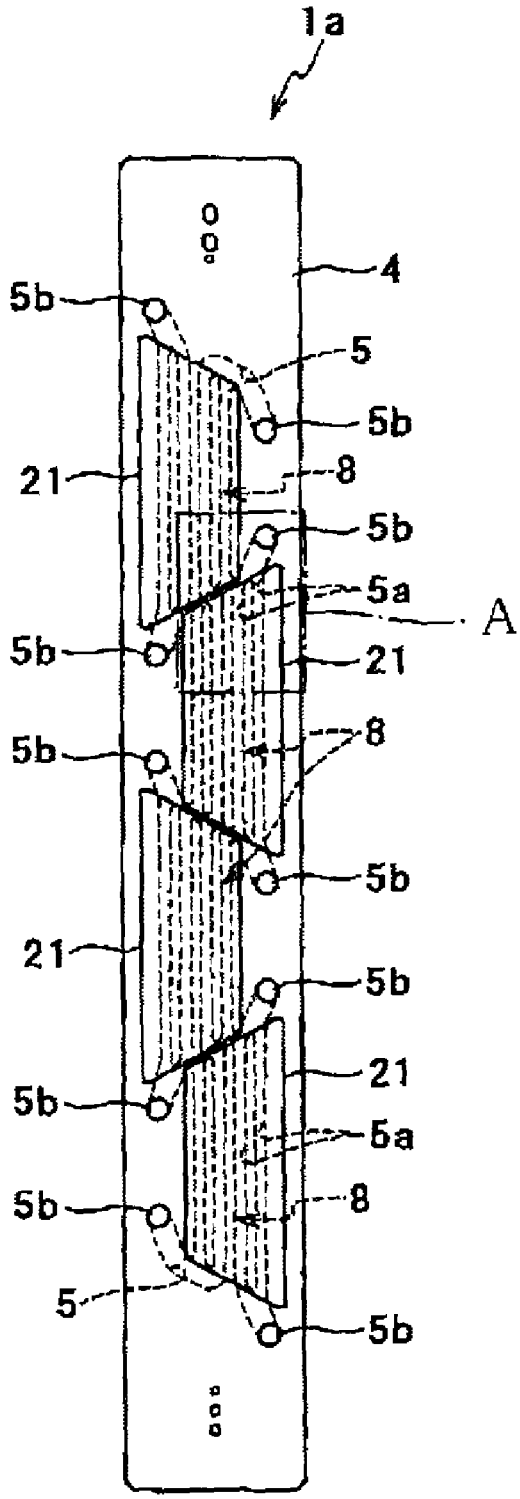
FIG. 5 is a plan view of the main portion of the ink-jet recording head.
Figure 6:
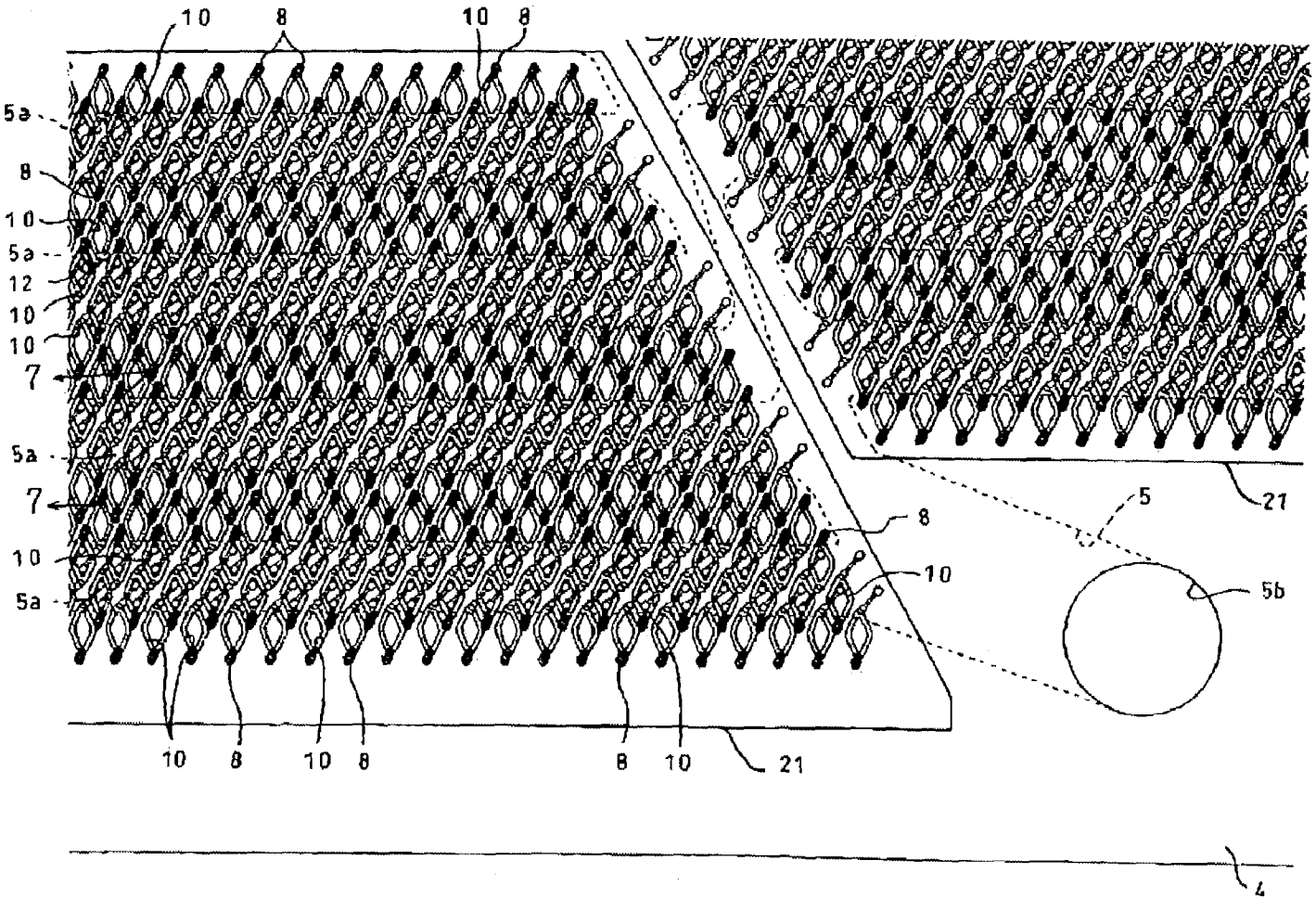
FIG. 6 is an enlarged view of a portion, A, of the main portion, indicated by one-dot chain line in FIG. 5.

Next, the main portion 1*a* of the ink-jet recording head 1 will be described by reference to FIGS. 5 through 8. FIG. 6 is an enlarged view of an area, A, indicated by one-dot chain line in FIG. 5. In FIG. 6, since nozzles 8, pressure chambers 10, and apertures 12 are located under the actuator units 21, those elements 8, 10, 12 should be drawn in broken lines. In fact, however, those elements 8, 10, 12 are drawn in solid lines, for easier understanding purposes only As shown in FIG. 5, the main portion 1*a* includes the flow-channel unit 4, and the four actuator units 21 fixed to the upper surface of the flow channel unit 4. Each of the actuator units 21 is for applying an ink-ejection energy to an arbitrary one of a corresponding one of four groups of pressure chambers 10 that are formed in the flow channel unit 4.

The flow channel unit 4 has a substantially rectangular-parallelepiped shape extending in the main scan direction. As shown in FIG. 6, the main portion 1*a* has, as a lower surface thereof, an ink ejection surface having a plurality of nozzles 8 arranged like a matrix. In addition, the flow-channel unit 4 has, in the upper surface thereof to which the actuator units 21 are fixed, a plurality of pressure chambers 10 that are arranged like a matrix such that the pressure chambers 10 correspond to the nozzles 8, respectively.

Figure 7:
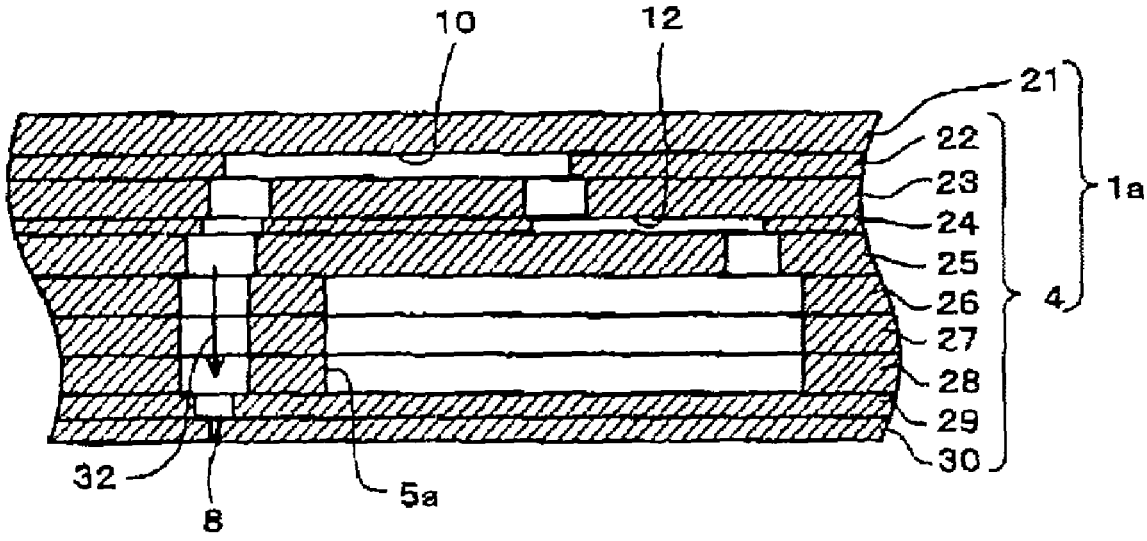
FIG. 7 is a cross-sectional view taken along 7-7 in FIG. 6.

As shown in FIG. 7, the flow-channel unit 4 has a stacked structure wherein nine metallic plates are stacked on each other. Those nine plates include a cavity plate 22, a base plate 23, an aperture plate 24, a supply plate 25, three manifold plates 26, 27, 28, a cover plate 29, and a nozzle plate 30.

As shown in FIG. 5, the flow-channel unit 4 has the plurality of ink supply ports 5*b* that open in the upper surface thereof such that the ink supply ports 5*b* correspond to the introduction-passage communication holes 62*a* or the ink introduction passages 63 (FIG. 4) of the reservoir unit 70, respectively. The flow-channel unit 4 has a plurality of manifold flow channels 5 that communicate with the ink supply ports 5*b*, respectively; and a plurality of sub-manifold flow channels 5*a* that are branched from the manifold flow channels 5. As shown in FIG. 7, each of the nozzles 8 communicates with a corresponding one of a plurality of individual flow channels 32 including the manifold flow channels 5, the sub-manifold flow channels 5*a*, and the pressure chambers 10. More specifically described, the ink is supplied from the reservoir unit 70 to the flow channel unit 4 via the ink supply ports 5*b*, then flows from the manifold flow channels 5 to the sub-manifold flow channels 5*a*, and reaches the nozzles 8 via the apertures 12 each as a restrictor, and the pressure chambers 10.

Figure 8:
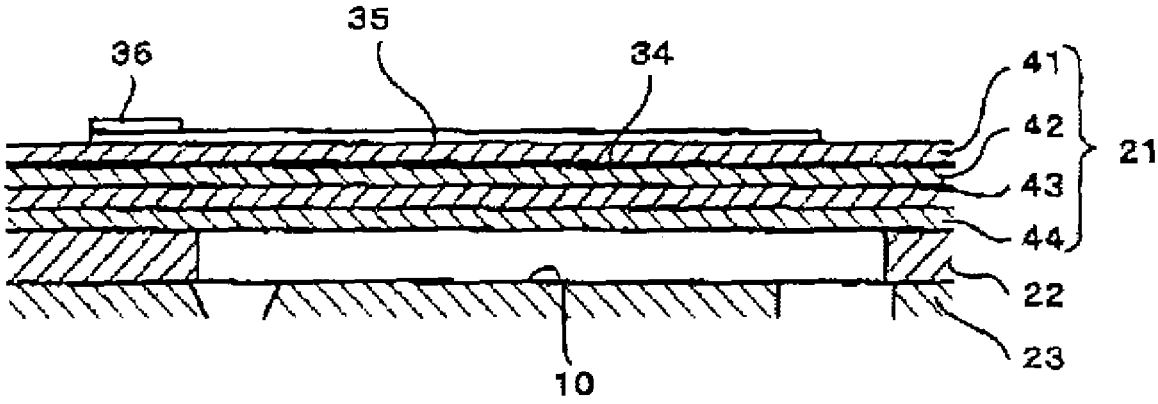
FIG. 8 is an enlarged cross-sectional view of an actuator unit of the main portion.

As shown in FIG. 5, each of the four actuator units 21 has a generally trapezoidal shape in its plan view. The four actuator units 21 are fixed to the upper surface of the flow-channel unit 4, such that the actuator units 21 are arranged in two arrays in a zigzag or staggered fashion, and such that each of the actuator units 21 does not overlap any of the ink supply ports 5*b* of the flow-channel unit 4. In addition, as shown in FIG. 8, each of the four actuator units 21 has a stacked structure in which four piezoelectric sheets 41, 42, 43, 44 are stacked on each other, and is fixed to the flow channel unit 4 such that the four piezoelectric sheets 41, 42, 43, 44 of the each actuator unit 21 are commonly opposed to the pressure chambers 10 of a corresponding one of the four groups of pressure chambers 10.

A plurality of individual electrodes 35 are formed on the uppermost piezoelectric sheet 41 of each actuator unit 21, such that the individual electrodes 35 correspond to the pressure chambers 10 of the corresponding pressure-chamber group, respectively. A sheet-like common electrode 34 is interposed between the uppermost piezoelectric sheet 41 and the underlying piezoelectric sheet 42, such that the common electrode 34 corresponds to the entirety of the two sheets 41, 42. No electrodes are provided between the two piezoelectric sheets 42, 43 or between the piezoelectric sheets 43, 44.

Each of the individual electrodes 35 has, in its plan view, a substantially rhomboidal shape similar to each pressure chamber 10. More specifically described, one of two acute-angle corners of the rhomboidal individual electrode 35 is extended and is electrically connected to a land 36. The lands 36, connected to the individual electrodes 35, are electrically connected to a plurality of terminals of a corresponding one of the four FPCs 50 (FIG. 3).

The common electrode 34 is grounded at a portion thereof, not shown, and is kept at a ground potential. On the other hand, respective electric potentials of the individual electrodes 35 of each actuator unit 21 can be controlled or changed, independent of each other, by a corresponding one of the four driver ICs 81*a* through respective independent leads of a corresponding one of the four FPCs 50 (FIG. 3) and the respective lands 36.

Next, a manner in which each actuator unit 21 is driven or operated will be described. Only the uppermost piezoelectric sheet 41 of each actuator unit 21 is polarized, in advance, in a direction of thickness thereof. Therefore, when an appropriate positive or negative electric voltage is applied to an arbitrary one of the individual electrodes 35, such that an electric field is produced in the same direction as the direction of polarization of a corresponding portion of the uppermost piezoelectric sheet 41 that is sandwiched by the arbitrary individual electrode 35 and the common electrode 34, the corresponding portion deforms owing to piezoelectric effect and thereby functions as an active portion. More specifically described, each of respective portions of the uppermost piezoelectric sheet 41 that are sandwiched by the individual electrodes 35 and the common electrode 34 expands or contracts in the direction of thickness thereof and contracts or expands, owing to transverse piezoelectric effect, in the direction perpendicular to the direction of thickness thereof. On the other hand, none of the other piezoelectric sheets 42, 43, 44 displaces because those sheets 42 through 44 include no portions sandwiched by the individual electrodes 35 and the common electrode 34 and accordingly are inactive portions that cannot be influenced by the electric field.

Thus, each actuator unit 21 has a "uni-morph" structure in which the uppermost piezoelectric sheet 41 distant from the pressure chambers 10 has the active portions and the other three piezoelectric sheets 42, 43, 44 near to the pressure chambers 10 have no active portions. The lower surface of each actuator unit 21 including the four piezoelectric sheets 41 through 44 is fixed to respective upper surfaces of a plurality of partition walls of the cavity plate 22 that define the pressure chambers 10. Therefore, if a strain difference is produced, in the direction perpendicular to the direction of thickness of each actuator unit 21, between each of the active portions of the uppermost piezoelectric sheet 41 and the underlying piezoelectric sheets 42, 43, 44, then the four piezoelectric sheets 41 through 44 are so deformed as to swell into the corresponding pressure chamber 10 (this is a "uni-morph" deformation). Thus, a volume of the pressure chamber 10 is decreased and a pressure of the ink present in the pressure chamber 10 is increased, so that the ink is expelled from the pressure chamber 10 toward the corresponding nozzle 8 and a droplet of the ink is ejected from the nozzle 8. Subsequently, when the electric potential of the individual electrode 35 is returned to the same level as that of the common electrode 34, the four piezoelectric sheets 41 through 44 are returned to their original shapes, so that the volume of the pressure chamber 10 is returned to its original volume and a certain amount of the ink is sucked from the corresponding manifold flow channel 5 into the pressure chamber 10.

Figure 9:
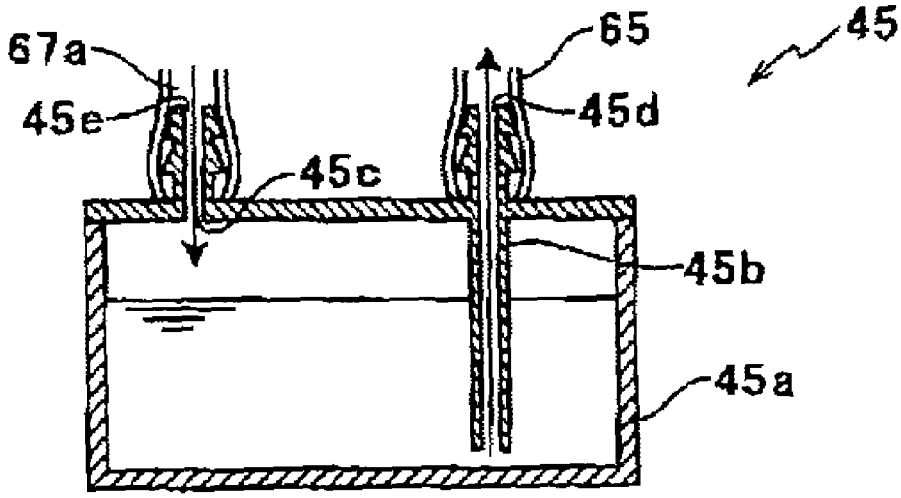
FIG. 9 is a cross-sectional view of an ink tank of the ink-jet printer.

Next, each of the four ink tanks 45 will be described by reference to a cross-sectional view thereof shown in FIG. 9. The four ink tanks 45 are for storing respective inks to be ejected by the four ink-jet recording heads 1. Those inks are a cyan ink, a yellow ink, a magenta ink, and a black ink. As shown in FIG. 9, each of the ink tanks 45 includes a main body 45*a*, an ink outflow tube 45*b*, and an air inflow tube 45*c*. The main body 45*a* is a box-like member that stores a corresponding ink, and has an inner air-tight space that is defined by closing, by supersonic welding, an upper opening of a lower box member with a lid member. Each of the ink outflow tube 45*b* and the air inflow tube 45*c* is inserted, through the lid member of the main body 45*a*, into the inner space thereof. The ink supply tube 65 is connected to a joint portion, i.e., an upper end portion of the ink outflow tube 45*b*, and a lower end portion (i.e., a lower open end) of the same 45*b* is located at a height position near to a bottom wall of the main body 45*a*, i.e., a height position lower than a level of the ink. An individual air supply tube 67*a* is connected to a joint portion, i.e., an upper end portion of the air inlet tube 45*c*, and a lower end portion (i.e., a lower open end) of the same 45*c* opens in a lower surface of the lid member of the main body 45*a*, i.e., a height position higher than the level of the ink. An upper open end of the ink outflow tube 45*b* constitutes an ink outlet 45*d*; and an upper open end of the air inflow tube 45*c* constitutes an air inlet 45*e*. In the air discharging operation, described later, air flows from the air inlet 45*e*, so that a pressure of the air in the main body 45*a* is increased and accordingly the ink is expelled from the ink outlet 45*d*.

Back to FIG. 1, the air pump 47 is for supplying, based on a command supplied from the control device 83, air to each of the ink tanks 45 via individual and common air supply tubes 67*a*, 67*b*. Each individual air supply tube 67*a* and the common air supply tube 67*b* cooperate with each other to constitute a second connector having an air supply passage.

Next, the switching unit 48 will be described by reference to FIGS. 10A, 10B, 10C, and 10D each of which shows a cross-sectional view of an upper portion of the unit 48, and FIGS. 10E, 10F, 10G, and 10H each of which shows a cross-sectional view of a lower portion of the unit 48. FIGS. 10A, 10B, 10C, and 10D show different operating states of the upper portion of the switching unit 48; and FIGS. 10E, 10F, 10G, and 10H show different operating states of the lower portion of the switching unit 48. The switching unit 48 is for selecting, based on a command supplied from the control device 83, one or more of the four ink tanks 45 to which air is to be supplied from the air tank 46, or selecting one or more of the four ink tanks 45 from which pressurized air is to be discharged into the atmosphere.

Figure 10A:
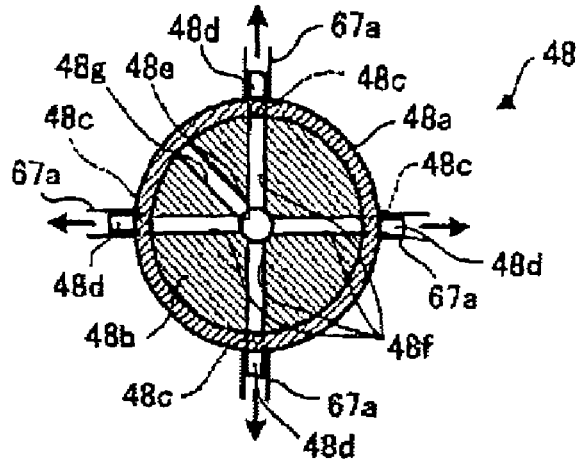
FIGS. 10A, 10B, 10C, and 10D are cross-sectional views showing different operating states of an upper portion of a switching unit of the ink-jet printer.

As shown in FIG. 10A, the switching unit 48 includes a cylindrical frame member 48*a* and a flow-passage member 48*b*. The cylindrical frame member 48*a* has an inner cylindrical space; eight through holes 48*c* that are formed through the thickness of the frame member 48*a* so as to connect between the inner cylindrical space thereof and an outer circumferential surface thereof, and eight joint portions 48*d* communicating with the eight through holes 48*c*, respectively. The eight through holes 48*c* open in the outer circumferential surface of the frame member 48*a*, such that the upper four through holes 48*c* are equiangularly distant from each other by 90 degrees and the lower four through holes 48*c* are equiangularly distant from each other by 90 degrees and are aligned with the upper four through holes 48*c*, respectively, in the vertical direction. The eight joint portions 48*d* communicate with the respective openings of the eight through holes 48*c*. Each of the four individual air supply tubes 67*a* are bifurcated into two tubular portions that are connected to a corresponding one of the four upper joint portions 48*d* and a corresponding one of the four lower joint portions 48*d*, respectively. Thus, each of the four ink tanks 45 communicates with the corresponding two through holes 48*c* via the corresponding individual air supply tube 67*a*, respectively.

The flow-passage member 48*b* has a cylindrical shape, and fits in the inner cylindrical space of the frame member 48*a* such that the flow-passage member 48*b* is freely rotatable. The flow-passage member 48*b* has, in the upper portion thereof shown in FIGS. 10A through 10D, a first main flow passage 48*e* extending along an axis line of rotation of the member 48*b*; and four first auxiliary flow passages 48*f* and one second auxiliary flow passage 48*g* each of which communicates with the first main flow passage 48*e*, extends in a radial direction of the member 48*b*, and opens in an outer circumferential surface of the member 48*b*. The four first auxiliary flow passages 48*f* are equiangularly distant from each other by 90 degrees; and the second auxiliary flow passage 48*g* opens, in the outer circumferential surface of the flow-passage member 48*b*, at a position distant from 45 degrees from each of the respective openings of two first auxiliary flow passages 48*f* out of the four passages 48*f*. The first main flow passage 48*e* communicates, at one of opposite ends thereof, with the four first auxiliary flow passages 48*f* and the second auxiliary flow passage 48*g*, and communicates, at the other end thereof, with the common air supply tube 67*b* (FIG. 1). Thus, the air tank 46 communicates with the first main flow passage 48*e* via the common air supply tube 67*b*.

In addition, the flow-passage member 48*b* has, in the lower portion thereof shown in FIGS. 10E through 10H, a second main flow passage 48*j* that extends along the axis line of rotation of the member 48*b*, is aligned with the first main flow passage 48*e* in the vertical direction, and is separated from the same 48*e* by an air-tight partition wall, not shown; and four third auxiliary flow passages 48*h* and one fourth auxiliary flow passage 48*i* each of which communicates with the third main flow passage 48*e*, extends in a radial direction of the member 48*b*, and opens in the outer circumferential surface of the member 48*b*. The four third auxiliary flow passages 48*h* are equiangularly distant from each other by 90 degrees; the fourth auxiliary flow passage 48*i* opens, in the outer circumferential surface of the flow-passage member 48*b*, at a position distant from 45 degrees from each of the respective openings of two third auxiliary flow passages 48*h* out of the four passages 48*h*; and the four third auxiliary flow passages 48*h* and the one fourth auxiliary flow passage 48*i* are distant by 22.5 degrees from the four first auxiliary flow passages 48*f* and the one second auxiliary flow passage 48*g*, respectively. The second main flow passage 48*j* communicates, at one of opposite ends thereof, with the four third auxiliary flow passages 48*h* and the one fourth auxiliary flow passage 48*i*, and communicates, at the other end thereof, with the atmosphere via an opening formed in a lower surface of the flow-passage member 48*b*.

Figure 10B:
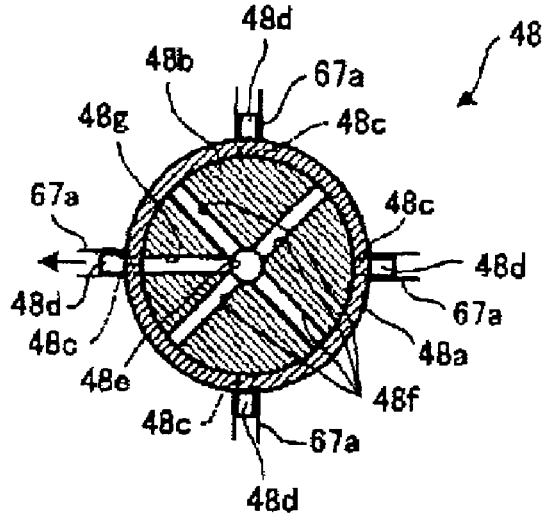
Figure 10C:
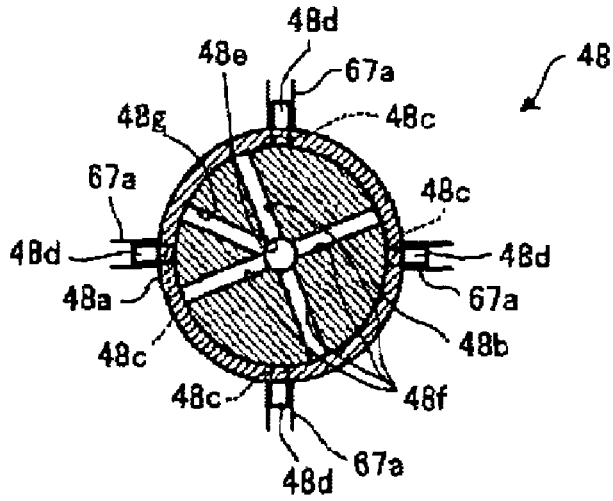
Figure 10D:
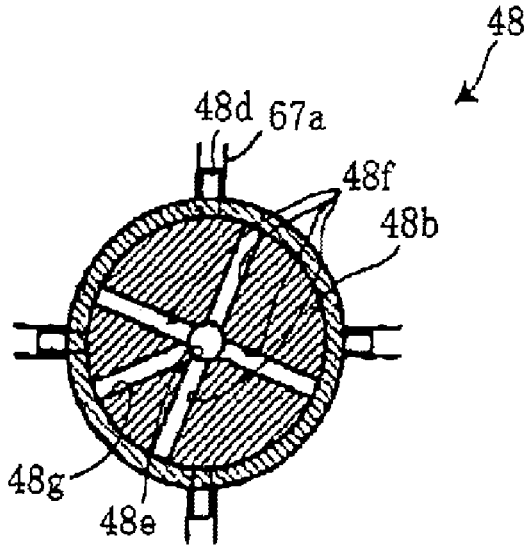
Figure 10E:
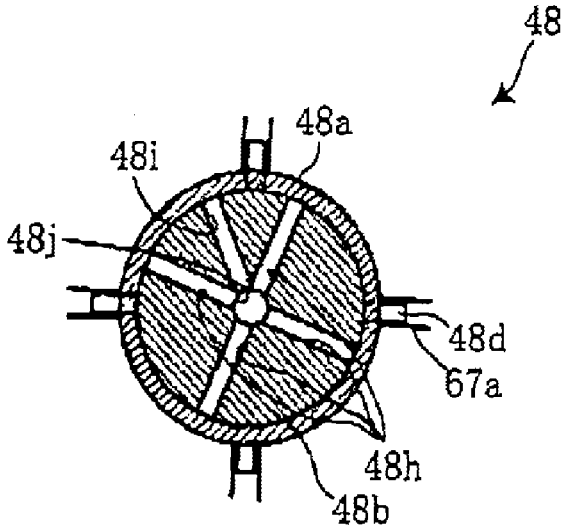
FIGS. 10E, 10F, 10G, and 10H are cross-sectional views showing different operating states of a lower portion of the switching unit that correspond to the different operating states of the upper portion of the switching unit shown in FIGS. 10A, 10B, 10C, and 10D, respectively.
Figure 10F:
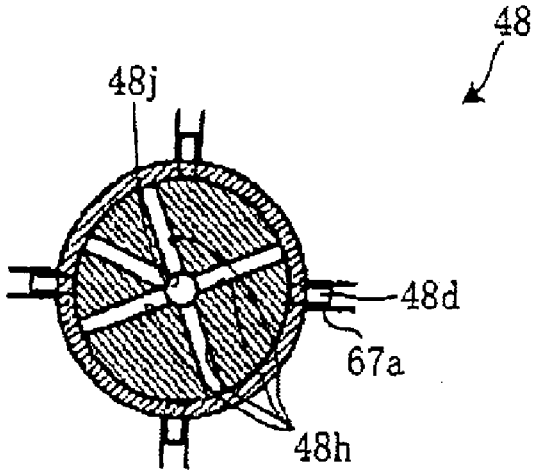
Figure 10G:
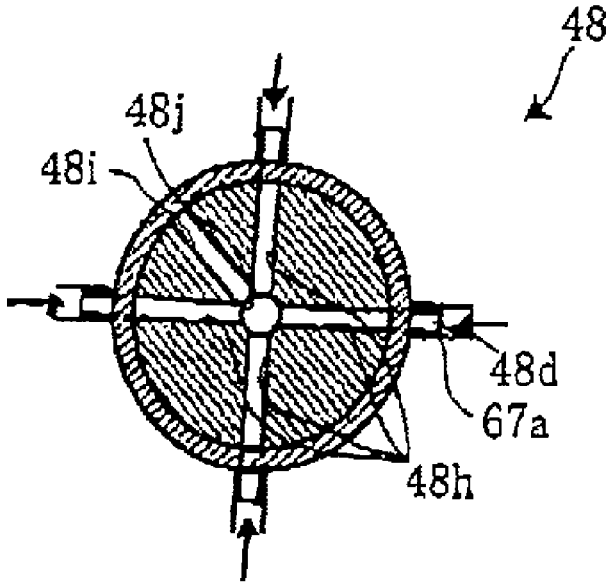
Figure 10H:
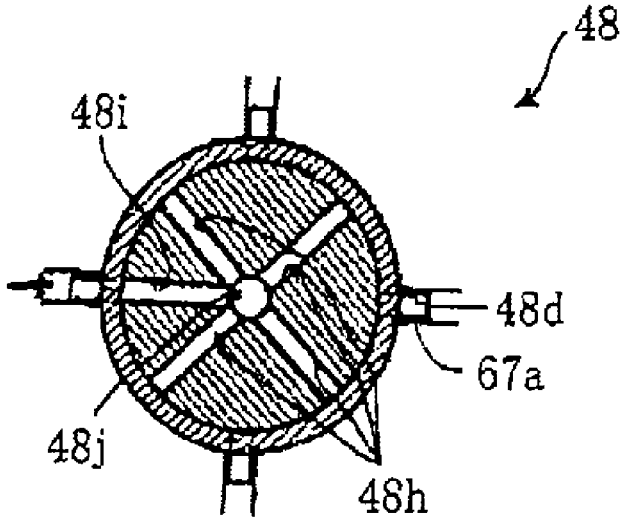

FIG. 10A shows a fully open state of the switching unit 48 in which the upper portion of the flow-passage member 48*b* takes a rotation position where the four first auxiliary flow passages 48*f* communicate with the four upper through holes 48*c*, respectively, so as to allow each of the four ink tanks 45 to communicate with the air tank 46. The fully open state of the switching unit 48 corresponds to a first fully non-communication state thereof shown in FIG. 10E, in which the lower portion of the flow-passage member 48*b* takes a rotation position where the four third auxiliary flow passages 48*h* do not communicate with the four lower through holes 48*c*, respectively, so as not to allow each of the four ink tanks 45 to communicate with the atmosphere. FIG. 10B shows a selectively open state of the switching unit 48 in which the upper portion of the flow-passage member 48*b* takes a rotation position where the second auxiliary flow passage 48*g* communicates with an arbitrary one of the four upper through holes 48*c*, so as to allow a corresponding one of the four ink tanks 45 to communicate with the air tank 46. The switching unit 48 can take an arbitrary one of four selectively open states respectively corresponding to the four ink tanks 45. The selectively open state of the switching unit 48 corresponds to a second fully non-communication state thereof, shown in FIG. 10F, in which the lower portion of the flow-passage member 48*b* takes a rotation position where the four third auxiliary flow passages 48*h* do not communicate with the four lower through holes 48*c*, respectively, so as not to allow each of the four ink tanks 45 to communicate with the atmosphere. FIG. 10C shows a first closed state of the switching unit 48 in which the upper portion of the flow-passage member 48*b* takes a rotation position where the first and second auxiliary flow passages 48*f*, 49*g* do not communicate with any of the four upper through holes 48*c* so as to inhibit the communication between each of the four ink tanks 45 and the air tank 46. The first closed state of the switching unit 48 corresponds to a full atmosphere-communication state thereof, shown in FIG. 10G, in which the lower portion of the flow-passage member 48*b* takes a rotation position where the four third auxiliary flow passages 48*h* communicate with the four lower through holes 48*c*, respectively, so as to allow each of the four ink tanks 45 to communicate with the atmosphere. FIG. 10D shows a second closed state of the switching unit 48 in which the upper portion of the flow-passage member 48*b* takes a rotation position where the first and second auxiliary flow passages 48*f*, 49*g* do not communicate with any of the four upper through holes 48*c* so as to inhibit the communication between each of the four ink tanks 45 and the air tank 46. The second closed state of the switching unit 48 corresponds to a selective atmosphere-communication state thereof shown in FIG. 10H, in which the lower portion of the flow-passage member 48*b* takes a rotation position where the fourth auxiliary flow passages 48*i* communicates with an arbitrary one of the four lower through holes 48*c*, so as to allow a corresponding one of the four ink tanks 45 to communicate with the atmosphere. The switching unit 48 can take an arbitrary one of four selective atmosphere-communication states respectively corresponding to the four ink tanks 45. The first and second closed states of the switching unit 48 can be said as a single closed state of the switching unit 48; and each of the full atmosphere-communication state and the selective atmosphere-communication state of the switching unit 48 can be considered as a sub-state of the single closed state of the switching unit 48.

Back to FIG. 1, the four air-discharge valves 49 are attached to the respective air-discharge tubes 68 of the four ink-jet recording heads 1, and are for allowing, based on respective commands supplied from the control device 83, the four ink-jet heads 1 to communicate with the atmosphere (FIG. 4).

A temperature-and-humidity detector or sensor 90 is for detecting a temperature and a humidity of an ambient air around the ink-jet printer 101, and supplies detection signals representing the detected temperature and humidity, to the control device 83.

Figure 11:
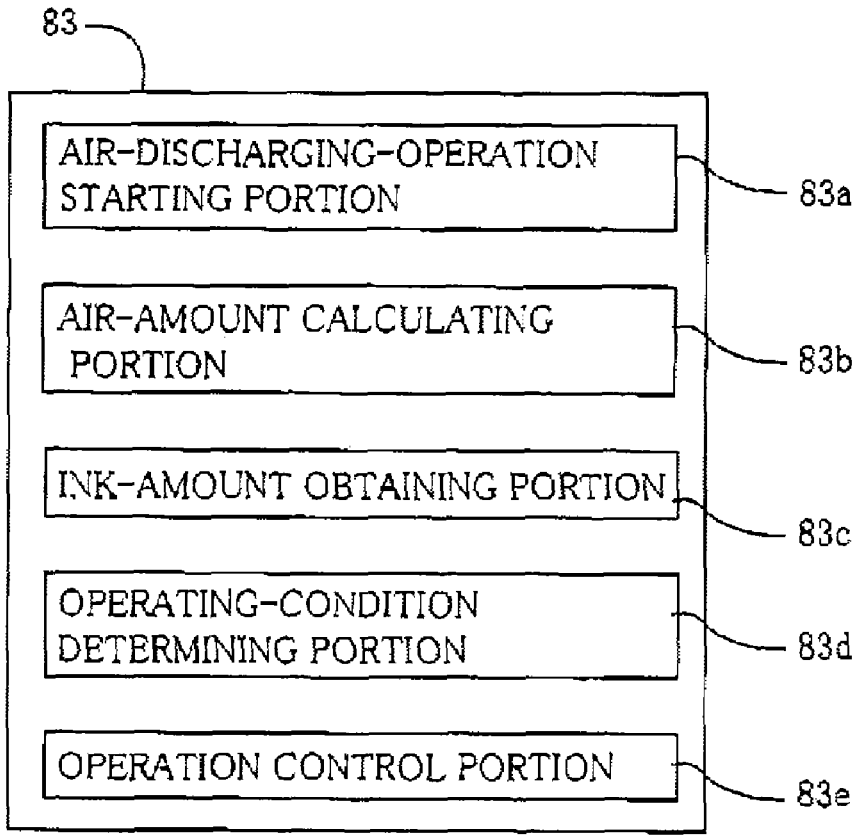
FIG. 11 is a diagrammatic view of a control device of the ink-jet printer.

Next, the control device 83 will be described by reference to FIG. 11. As described above, the control device 83 controls the ink-jet printer 101 as a whole, e.g., the ink-jet recording heads 1, the air pump 47, the switching unit 48, and the air-discharge valves 49. The following description is focused on the function of the ink-jet printer 101 to carry out the air discharging operation in which air is supplied from the ink pump 47 to the ink tank(s) 45 so as to remove forcibly the air bubbles and the deteriorated ink(s) from the ink supply tube(s) 65 and the ink inflow passage(s) 61 via the air-discharge tube(s) 68 and the ink-jet head(s) 1. As shown in FIG. 11, the control device 83 includes an air-discharging-operation starting portion 83*a*, an air-amount calculating portion 83*b*, an ink-amount obtaining portion 83*c*, an operating-condition determining portion 83*d*, and an operation control portion 83*e*. In addition, the control device 83 includes an input device such as a keyboard or a mouse that is operable by a user to input an air-discharging-operation starting command, described later. The air-amount calculating portion 83*b* corresponds to an obtaining portion that obtains a volume of air present in the ink supply tube 65 and the ink inflow passage 61 corresponding to each ink-jet recording head 1.

The air-discharging-operation starting portion 83*a* starts an air discharging operation when a user inputs a command to start the operation, or when a predetermined time has elapsed since the last air discharging operation was carried out.

The air-amount calculating portion 83*b* calculates an amount (i.e., a volume) of air present in the ink supply tube 65 and the ink inflow passage 61 corresponding to each of the ink-jet recording heads 1. As time elapses, ambient air permeates, little by little, the wall of each ink supply tube 65, and grows into air bubbles some of which move into, and are accumulated in, the corresponding ink inflow passage 61. As described above, the Inventor has found that an amount, V (mL), of air present in the ink supply tube 65 and the ink inflow passage 61 corresponding to each ink-jet head 1 can be expressed, using an elapsed time, t, from an initial time, t=0, as a reference time, by the following equation:

$$V=a\times e^{bt}$$

where a, b are coefficients, and e is a base of a natural algorithm.

The coefficient a represents an amount (ML) of air present in the ink supply tube 65 and the ink inflow passage 61 at the initial time, t=0. In addition, the coefficient b represents a material of each flexible ink supply tube 65; a thickness of the wall of the each ink supply tube 65, the wall defining an inner space of the tube 65; an area of a cross section of the inner space of the each ink supply tube 65, the cross section being taken along a plane perpendicular to a direction in which the ink flows; and a permeability of air through the wall of the each ink supply tube 65, the permeability depending upon a temperature and a humidity of the ambient air. The material, wall thickness, and cross-section area of each ink supply tube 65 are determined when the ink-jet printer 101 are originally designed, and those are characteristic values of the same 65.

Figure 12A:
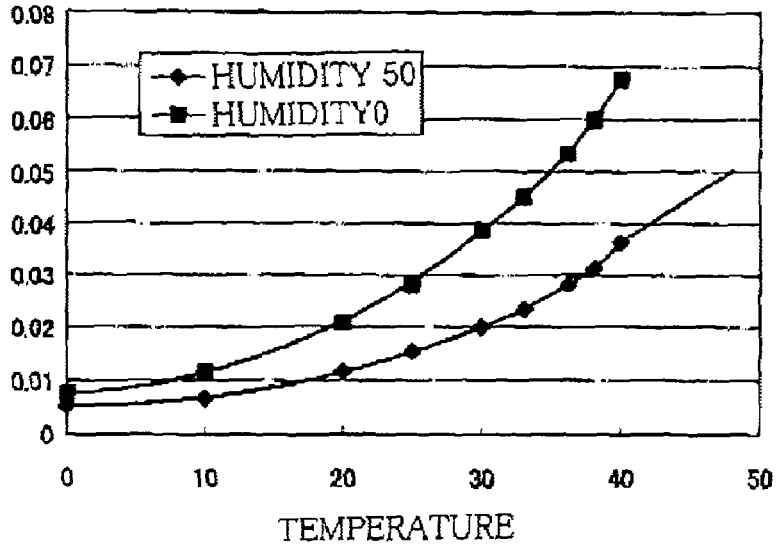
FIG. 12A is a graph showing a relationship between coefficient, b, and temperature and humidity according to which a coefficient b is determined by the control device for a black ink.
Figure 12B:
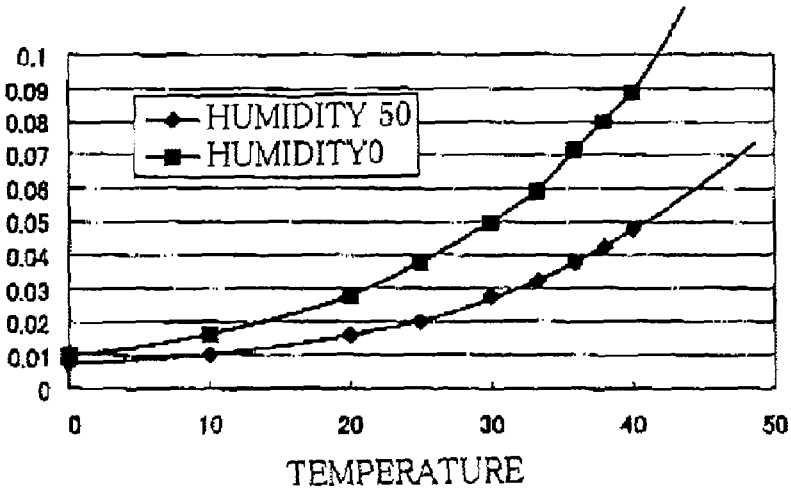
FIG. 12B is a graph showing a relationship between coefficient b and temperature and humidity according to which a coefficient b is determined by the control device for a color ink.

The air-amount calculating portion 83*b* temporarily determines a coefficient b based on the material, wall thickness, and cross-section area of each ink supply tube 65 and pre-selected temperature and humidity of the ambient air. In addition, the air-amount calculating portion 83*b* corrects the temporarily determined coefficient b based on the actual temperature and humidity of the ambient air, detected by the temperature-and-humidity sensor 90. Here, respective characteristics of the coefficient b with respect to temperature and humidity are explained by reference to FIGS. 12A and 12B. FIG. 12A shows a graph representing respective temperature characteristics of the coefficient b with respect to 0% humidity and 50% humidity in the case where the black ink is supplied through the ink supply tube 65; and FIG. 12B shows a graph representing respective temperature characteristics of the coefficient b with respect to 0% humidity and 50% humidity in the case where the color ink (i.e., the cyan, yellow, or magenta ink) is supplied through the ink supply tube 65. An axis of ordinates of the graph shown in each of FIGS. 12A and 12B indicates the coefficient b; and an axis of abscissas of the graph indicates the temperature. As shown in FIGS. 12A and 12B, the coefficient b increases as the temperature increases, and decreases as the humidity increases.

In the present embodiment, a time when the last air discharging operation is carried out is used as the initial time, t=0, and the elapsed time t is measured from the initial time. In addition, 0.014 (mL) is used as the coefficient a, i.e., an amount of air present in the ink supply tube 65 and the ink inflow passage 61 at the initial time, t=0. This value of the coefficient a is experimentally obtained. Thus, the air-amount calculating portion 83*b* calculates the air amount V as a function of the elapsed time t, i.e., according to the following equation: $V=0.014\times e^{bt}$.

The ink-amount obtaining portion 83*c* obtains an amount of the ink present in each of the ink tanks 45. More specifically described, the ink-amount obtaining portion 83*c* counts a total number of droplets of the ink ejected by the nozzles 8 of each ink-jet recording head 1 in all printing operations, and multiplies the counted number by an amount (i.e., a volume) of each ink droplet so as to obtain an ink consumption amount, and adds, to the thus obtained ink consumption amount, a total amount of the ink that is consumed when the air-discharging operations are carried out periodically or regularly, and irregularly when the user intends to recover the each ink-jet head 1 from a failure thereof to eject the ink. The ink-amount obtaining portion 83*a* calculates an amount (i.e., a volume) of the ink present in each ink tank 45, by subtracting the thus calculated ink consumption amount from an initial ink amount stored by the same 45. However, in addition to, or in place of, the ink-amount obtaining portion 83*a*, the control device 83 may employ an air-amount obtaining portion that obtains an amount (i.e., a volume) of air present in each ink tank 45, by subtracting the thus calculated ink volume from a volume of the same 45.

The operating-condition determining portion 83*d* determines, based on the amount (i.e., volume) of air present in the ink supply tube 65 and the ink inflow passage 61, calculated by the air-amount calculating portion 83*b*, and the ink amount (i.e., volume) obtained by the ink-amount obtaining portion 83*c*, respective operating conditions of the air pump 47 and the switching unit 48 for the air discharging operation. More specifically described, the respective operating conditions of the air pump 47 and the switching unit 48 are determined such that when the air discharging operation is carried out, the air pressure in the corresponding ink tank 45 is controlled to an appropriate value (i.e., a purging pressure, E) assuring that substantially all the amount (i.e., volume V) of air calculated by the air-amount calculating portion 83*b* is discharged into the outside space through the air-discharge passage 64. The respective operating conditions of the air pump 47 and the switching unit 48 determined by the operating-condition determining portion 83*d* include placing the switching unit 48 in its fully or selectively open state, and additionally operating, in a state in which the switching unit 48 is placed in its fully or selectively open state, the air pump 47 at a selected rotation speed (rpm) and for a selected time period, T, and opening the air-discharge valve 49 for the selected time period T. For example, the above-indicated purging pressure E may be directly proportional with the calculated air volume V. To this end, the rotation speed (rpm) of the air pump 47 may be directly proportional with the calculated air volume V. In the last case, the time period T of the air pump 47 may be a predetermined constant value.

Whether the switching unit 48 takes the fully open state or any one of the four selectively open states depends on the number of the ink-jet recording head(s) 1 for which the air discharging operation is carried out. More specifically described, in the case where the air discharging operation is carried out for an arbitrary one of the four ink-jet heads 1, the switching unit 48 is switched, at an appropriate timing, to a corresponding one of the four selectively open states; and in the case where the air discharging operation is carried out for all the four ink-jet heads 1, the switching unit 48 is switched, at an appropriate timing, to the fully open state.

The operation control portion 83*e* controls, when the air discharging operation is carried out, the air pump 47, the switching unit 48, and the air-discharge valve(s) 49, according to the operating conditions determined by the operating-condition determining portion 83*d*.

Next, an operation of the control device 83 will be described by reference to a flow chart shown in FIG. 13. When the ink-jet printer 101 is started, first, at Step S101, the air-discharging-operation starting portion 83*a* judges whether a user has inputted a command to carry out the air discharging operation. If a negative judgment is made at Step S101, the control of the control device 83 goes to Step S102 to judge whether a predetermined time has elapsed since the last air discharging operation was carried out. If a negative judgment is made at Step S102, the control goes back to Step S101. On the other hand, if a positive judgment is made at Step S101 or Step S102, the control goes to Step S103 where the air-amount calculating portion 83*b* calculates, using the coefficient b corrected based on the temperature and humidity of the ambient air detected by the temperature-and-humidity sensor 90, an amount (i.e., a volume V) of air present in the ink supply tube 65 and the ink inflow passage 61 corresponding to each ink-jet recording head 1. Then, at Step S104, the air discharging operation is carried out.

Next, an operation of the control device 83 to carry out the air discharging operation at Step S104 of FIG. 13 will be described by reference to a flow chart shown in FIG. 14. When the air discharging operation is started, first, at Step S201, the ink-amount obtaining portion 83*c* obtains an amount of the ink present in each ink tank 45. Subsequently, at Step S202, the operating-condition determining portion 83*d* determines, based on the air amount(s) calculated by the air-amount calculated portion 83*b*, the ink amount(s) obtained by the ink-amount obtaining portion 83*c*, and the selected state (i.e., the fully or selectively open state) of the switching unit 48, a rotation speed (rpm) and an operation time, T, of the air pump 47.

Subsequently, at Step S203, the switching unit 48 is placed in its fully open state or selectively open state; and at Step S204, the air pump 47 is operated at the rotation speed (rpm) determined at Step S202, for the operation time T also determined at Step S202 and, when the operation of the air pump 47 ends, the appropriate air-discharge valve(s) 49 is or are changed from the closed state thereof to the opened state thereof. Thus, the air is supplied from the air pump 47 to the ink tank(s) 45, and accordingly the air pressure(s) in the ink tank(s) 45 is or are increased up to the purging pressure E, so that appropriate amount(s) of ink(s) flows or flow from the ink outlet(s) 45*d* of the ink tank(s) 45. The ink(s) flowing from the ink outlet(s) 45*d* of the ink tank(s) 45 flows or flow, together with the air present in the ink supply tube(s) 65, into the ink inflow passage(s) 61 of the reservoir unit(s) 70. The air and ink(s) flowing in the ink inflow passage(s) 61 flow from the air-discharge valve communicating hole(s) 61*c* into the air-discharge passage(s) 64, and finally are discharged from the air-discharge tube(s) 68 into the outside space.

At Step S205, after a predetermined time has elapsed, the air-discharge valve(s) is or are closed, and the switching unit 48 is switched to the full or selective atmosphere-communication state. Thus, the air pressure(s) in the ink tank(s) 45 is or are instantaneously returned to the atmospheric pressure, so that the flowing of the ink(s) from the ink tank(s) 45 is instantaneously stopped. Thus, one air discharging operation is finished.

As is apparent from the foregoing description of the ink-jet printer 101 as the first embodiment, the operating-condition determining portion 83*d* determines, based on the air amount(s) V in the ink supply tube(s) 65 and the ink inflow passage(s) 61, calculated by the air-amount calculating portion 83*c*, the respective operating conditions of the air pump 47, the switching unit 48, and the air-discharge valve(s) 49, for the air discharging operation. Therefore, when the air discharging operation is carried out, substantially no ink is consumed uselessly, while the ink-ejecting performance of each ink-jet recording head 1 is maintained.

In addition, the air-discharging-operation starting portion 83*a* starts the air discharging operations periodically, i.e., at the predetermined regular intervals of time. Therefore, the user need not operate the ink-jet printer 101 to carry out the air discharging operations.

In addition, the air-discharging-operation starting portion 83*a* starts the air discharging operation when the user inputs the command to carry out the operation. Therefore, the user can operate, at a desired timing, the ink-jet printer 101 to carry out the air discharging operation.

Moreover, the air-amount calculating portion 83*b* determines the coefficient b based on the material of each ink supply tube 65; the thickness of the wall of the each ink supply tube 65; the area of the cross-sectional area of the inner space of the each ink supply tube 65; and the preselected temperature and humidity of ambient air, and corrects the thus determined coefficient b based on the actual temperature and humidity of the ambient air. Therefore, the amount of the air present in the ink supply tube 65 and the ink inflow passage 61 corresponding to each ink-jet recording head 1 can be accurately calculated.

In addition, the single switching unit 48 is commonly used for the plurality of ink-jet recording heads 1. Thus, the ink-jet printer 101 can be produced at low cost.

In addition, the switching unit 48 can be placed in the full or selective atmosphere-communication state in which the unit 48 allows each, or an arbitrary one of, the ink tanks 45 to communicate with the atmosphere. Therefore, the air discharging operation can be quickly stopped by placing the switching unit 48 in the full or selective atmosphere-communication state and thereby allowing all, or an arbitrary one of, the ink tanks 45*s* to communicate with the atmosphere. Thus, the flowing of the ink(s) from the ink tank(s) 45 can be instantaneously stopped, and the useless consumption of the ink(s) can be effectively prevented.

In a modified form of the first embodiment, the ink-jet printer 101 may be operated such that the air discharging operation is carried out immediately before each printing (or recording) operation is started. In another modified form of the first embodiment, the ink-jet printer 101 may be operated such that if the power of the printer 101 is in an "off" state when the predetermined regular interval of time has just elapsed since the last air discharging operation, then the next air discharging operation is carried out immediately after the power of the printer 101 is turned "on" again.

Second Embodiment

Figure 15:
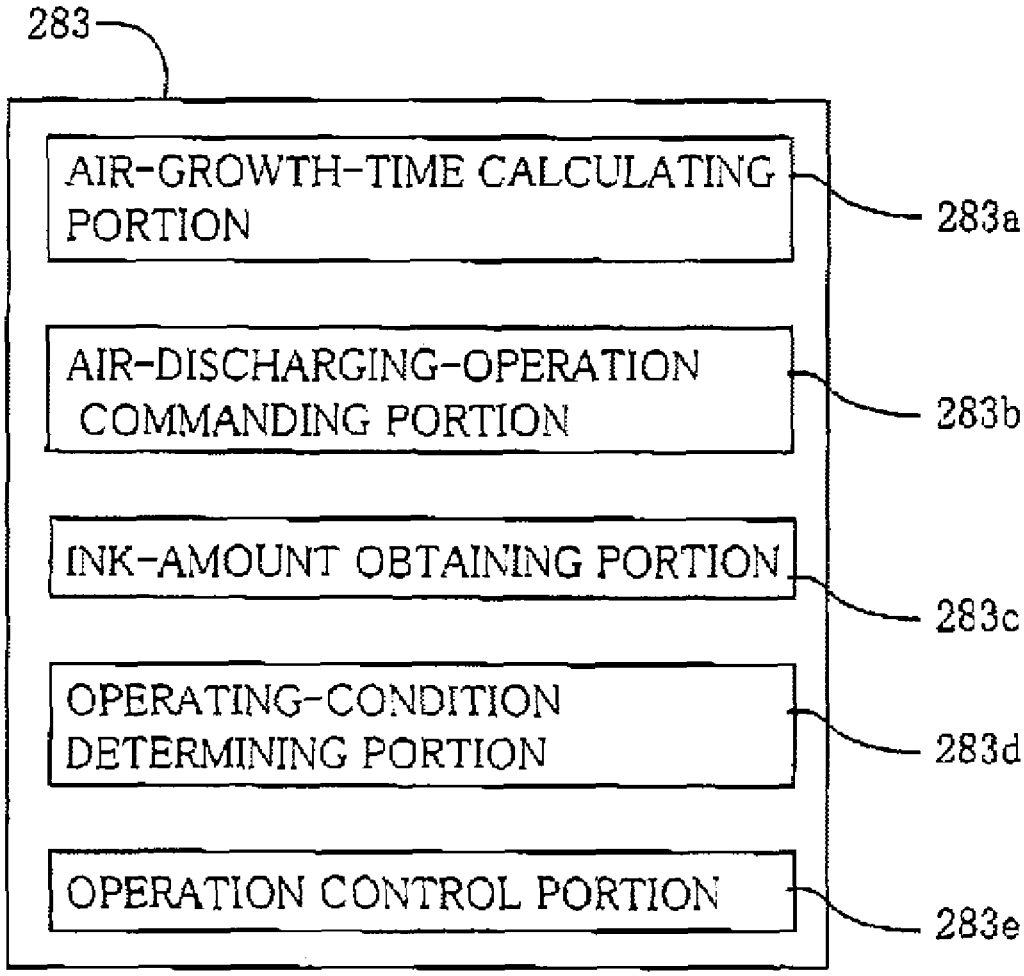
FIG. 15 is a diagrammatic view corresponding to FIG. 11 and showing another control device of another ink-jet printer as a second embodiment of the present invention.
Figure 16:
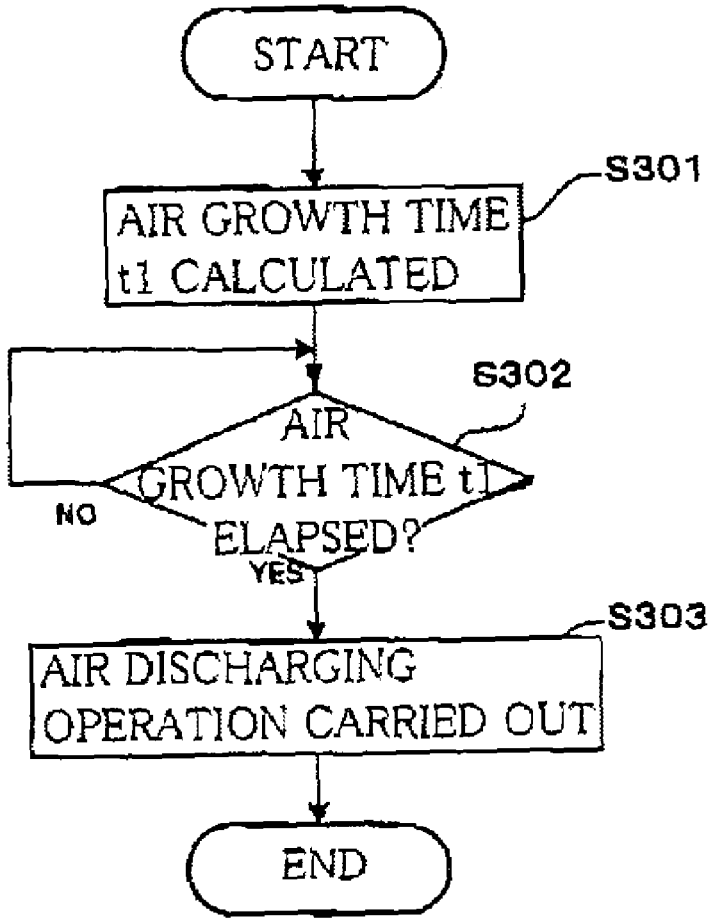
FIG. 16 is a flow chart corresponding to FIG. 13 and representing another main control program according to which the control device of FIG. 15 controls the ink-jet printer.

Next, a second embodiment of the present invention will be described by reference to FIGS. 15 and 16. The second embodiment relates to an ink-jet printer having the same hardware construction as that of the ink-jet printer 101 shown in FIGS. 1 through 9 and 10A through 10H. The ink-jet printer as the second embodiment differs from the ink-jet printer 101 as the first embodiment, with respect to only the functions of a control device 283. The same reference numerals as used in the first embodiment shown in FIGS. 1 through 9, 10A through 10H, and 11 are used to designate the corresponding elements or parts of the second embodiment, and the description thereof is omitted. FIG. 15 shows the functions of the control device 283 of the ink-jet printer as the second embodiment. The control device 283 controls the ink-jet printer as a whole, e.g., the ink-jet recording heads 1, the air pump 47, the switching unit 48, and the air-discharge valves 49. As shown in FIG. 15, the control device 283 includes an air-growth-time calculating portion 283*a*; an air-discharging-operation commanding portion 283*b*; the ink-amount obtaining portion 83*c*; an operating-condition determining portion 283*d*; and the operation control portion 83*c* Since the ink-amount obtaining portion 83*c* and the operation control portion 83*c* employed in the second embodiment are identical with the ink-amount obtaining portion 83*c* and the operation control portion 83*c* employed in the first embodiment, respectively, the description thereof is omitted. The air-growth-time calculating portion 283*a* corresponds to an obtaining portion that obtains an elapsed time from a reference time.

The air-growth-time calculating portion 283*a* calculates, based on the actual temperature and humidity of the ambient air detected by the temperature-and-humidity sensor 90, an air growth time, t1, measured from the last air discharging operation (i.e., an initial time, t=0), during which an amount V of air present in the ink supply tube 65 and the ink inflow passage 61 corresponding to each ink-jet recording head 1 grows, i.e., increases up to a maximum permissible amount, $V_0$, at which the each recording head 1 can exhibit its adequate ink-ejecting performance. More specifically described, the air growth time t1 can be expressed, using the maximum permissible amount $V_0$ (mL), by the following equation:

$$V_0 = a \times e^{bt1}$$

where a, b are coefficients; and e is a base of a natural algorithm.

Since the coefficients a, b have been described in connection with the first embodiment, the description thereof is omitted.

Moreover, the air-growth-time calculating portion 283*a* temporarily determines the coefficient b based on the material of each ink supply tube 65; the thickness of the wall of the each ink supply tube 65; the area of the cross section of the inner space of the each ink supply tube 65; and the pre-selected temperature and humidity of ambient air, and corrects the thus determined coefficient b based on the actual temperature and humidity of the ambient air.

In the present embodiment, a time when the last air discharging operation was carried out is used as the initial time, t=0, and the elapsed time t is measured from the initial time. In addition, 0.014 (mL) is used as the coefficient a, i.e., an amount (mL) of air present in the ink supply tube 65 and the ink inflow passage 61 at the initial time, t=0. This value of the coefficient a is experimentally obtained. Thus, the air-amount calculating portion 83*b* calculates the air amount V as a function of the elapsed time t, i.e., according to the following equation: $V=0.014\times e^{bt}$. TABLE 1 shows a relationship between air growth time t1 (hour) and ambient-air temperature (° C.) with respect to the ink supply tube 65 through which the black ink is supplied; and a relationship between air growth time t1 (hour) and ambient-air temperature (° C.) with respect to the ink supply tube 65 through which the color ink (i.e., the cyan, yellow, or magenta ink) is supplied.

TABLE 1

| Temperature (° C.) | Black Ink (hours) | Color Ink (hours) |
|---|---|---|
| up to 30 | 480 | 480 |
| 30 to 35 | 320 | 330 |
| 35 to 40 | 248 | 247 |
| 40 to 45 | 192 | 183 |
| 45 to 50 | 154 | 141 |

As shown in TABLE 1, as the ambient-air temperature increases, the speed of growth of the air present in the ink supply tube 65 and the ink inflow passage 61 increases like an exponential function, i.e., the air growth time t1 decreases exponentially.

The air-discharging-operation commanding portion 283*b* commands starting of an air discharging operation when the air growth time t1 has elapsed from the last air discharging operation.

The operating-condition determining portion 283*d* determines, based on the ink amount obtained by the ink-amount obtaining portion 83*c*, respective operating conditions of the air pump 47, the switching unit 48, and the air-discharge valve(s) 49, for the air discharging operation. More specifically described, the respective operating conditions of the air pump 47, the switching unit 48, and the air-discharge valve 49 are determined such that when the air discharging operation is carried out, the air pressure in the corresponding ink tank 45 is controlled to an appropriate value (i.e., a purging pressure E) assuring that the maximum permissible amount $V_0$ of air present in the ink supply tube 65 and the ink inflow passage 61 is discharged into the outside space. The respective operating conditions of the air pump 47, the switching unit 48, and the air-discharge valve 49 determined by the operating-condition determining portion 283*d* include placing the switching unit 48 in its fully or selectively open state, and additionally operating the air pump 47 at a selected rotation speed (rpm) and for a selected time period T, and opening the air-discharge valve 49 for the selected time period T.

Next, an operation of the control device 283 will be described by reference to a flow chart shown in FIG. 16. When the present ink-jet printer is started, first, at Step S301, the air-growth-time calculating portion 283*a* calculates the air growth time t1 measured from the last air discharging operation, i.e., the initial time, t=0. Then, at Step S302, the air-discharging-operation commanding portion 283*b* judges whether the air growth time t1 has elapsed since the last air discharging operation was carried out. If a negative judgment is made at Step S302, Step S302 is repeated. On the other hand, if a positive judgment is made at Step S302, the control goes to Step S303 to carry out the air discharging operation. Since this operation is carried out according to the flow chart shown in FIG. 14, employed in the first embodiment, the description thereof is omitted. However, at a step corresponding to Step S202 of FIG. 14, i.e., an operating-condition determining step, the operating-condition determining portion 283*d* determines, based on only the ink amount obtained by the ink-amount obtaining portion 83*c*, the respective operating conditions of the air pump 47, the switching unit 48, and the air-discharge valve(s) 49 for the air discharging operation.

As is apparent from the foregoing description of the ink-jet printer as the second embodiment, the air discharging operation is carried out each time the amount V of the air present in the ink supply tube 65 and the ink inflow passage 61 corresponding to each ink-jet recording head 1 reaches the maximum permissible amount $V_0$. Therefore, the amount of the ink uselessly consumed during the air discharging operation can be reduced, while the ink-ejecting performance of the each recording head 1 is maintained.

In addition, the air-growth-time calculating portion 283*a* determines the coefficient b based on the material of each ink supply tube 65; the thickness of the wall of the each ink supply tube 65; the area of the cross section of the inner space of the each ink supply tube 65; and the pre-selected temperature and humidity of ambient air, and corrects the thus determined coefficient b based on the actual temperature and humidity of the ambient air. Therefore, the air growth time t1 in which the air present in the ink supply tube 65 and the ink inflow passage 61 corresponding to each ink-jet recording head 1 reaches the maximum permissible amount $V_0$ can be accurately calculated.

In a modified form of the second embodiment, the ink-jet printer may be operated such that if the power of the printer is in an off state when the calculated air growth time t1 has elapsed since the last air discharging operation, then the next air discharging operation is carried out in the same manner as described above, when the power of the printer is turned on again within a pre-selected time period following the air growth time t1. However, if the power of the printer is turned on again after the pre-selected time period has elapsed following the air growth time t1, it is preferred that the air discharging operation be carried out with respective operating conditions of the air pump 47, the switching unit 48, and the air-discharge valve(s) 49 that are so changed or modified as to assure that all amounts of air that are then present in the ink supply tube 65 and the ink inflow passage 61 that are more than the maximum permissible amount $V_0$ can be discharged into the outside space. The above-indicated case in which the power of the ink-jet printer is in the off state is an example of a timing at which the air discharging operation cannot be carried out by the printer.

Third Embodiment

Figure 17:
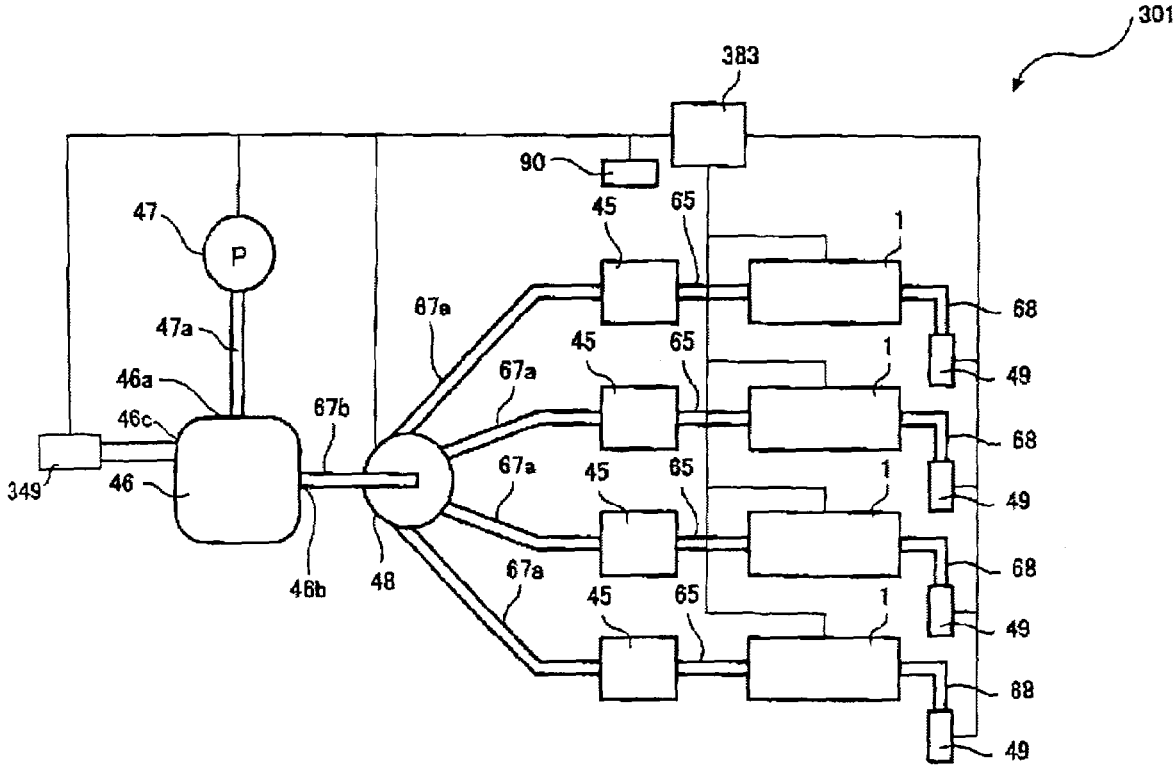
FIG. 17 is a schematic view corresponding to FIG. 1 and showing another ink-jet printer as a third embodiment of the present invention.

Next, a third embodiment of the present invention will be described by reference to FIG. 17. The third embodiment relates to an ink-jet printer 301, shown in FIG. 17, for ejecting droplets of inks toward a recording medium and thereby forming desired images on the same. The same reference numerals as used in the first embodiment shown in FIGS. 1 through 9, 10A through 10H, and 11 are used to designate the corresponding elements or parts of the third embodiment, and the description thereof is omitted. As shown in FIG. 17, the ink-jet printer 301 includes the four ink-jet recording heads 1, the four ink tanks 45 corresponding to the four ink-jet recording heads 1; an air tank 46; the air pump 47; the switching unit (i.e., air valve) 48; the four air-discharge valves 49; the temperature humidity sensor 90; an atmosphere-communication air valve 349; and a control device 383.

The air tank 46 has an air supply port 46*a*, an air outlet 46*b*, and an atmosphere-communication port 46*c*, and stores pressurized air supplied from the air pump 47 through the air supply port 46*a*. The common air supply tube 67*b* communicating with the switching unit 48 is connected to the air outlet 46*b*, and an air-pump communication tube 47*a* communicating with the air pump 47 is connected to the air supply port 46*a*. The atmosphere-communication air valve 349 is connected to the atmosphere-communication port 46*c* of the air tank 46. The pressurized air stored by the air tank 46 is supplied to each of the four ink tanks 45 via the common air supply tube 67*b* and the corresponding individual air supply tube 67*a*. The air pump 47 supplies, based on a command supplied from the control device 283, pressurized air to the air tank 46 via the air-pump communication tube 47*a*. Thus, the air tank 46, the air pump 47, and the air-pump communication tube 47*a* cooperate with each other to constitute an air supplying device.

Figure 13:
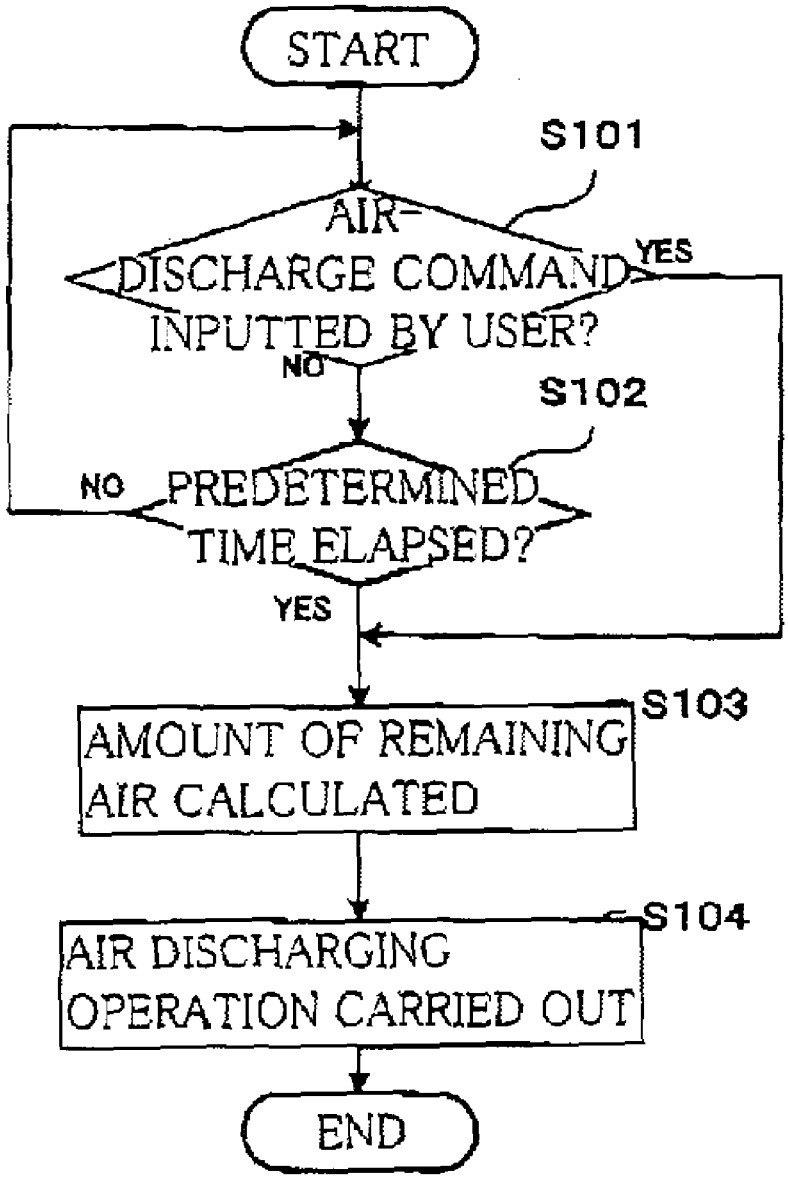
FIG. 13 is a flow chart representing a main control program according to which the control device controls the ink-jet printer to carry out an air discharging operation.
Figure 14:
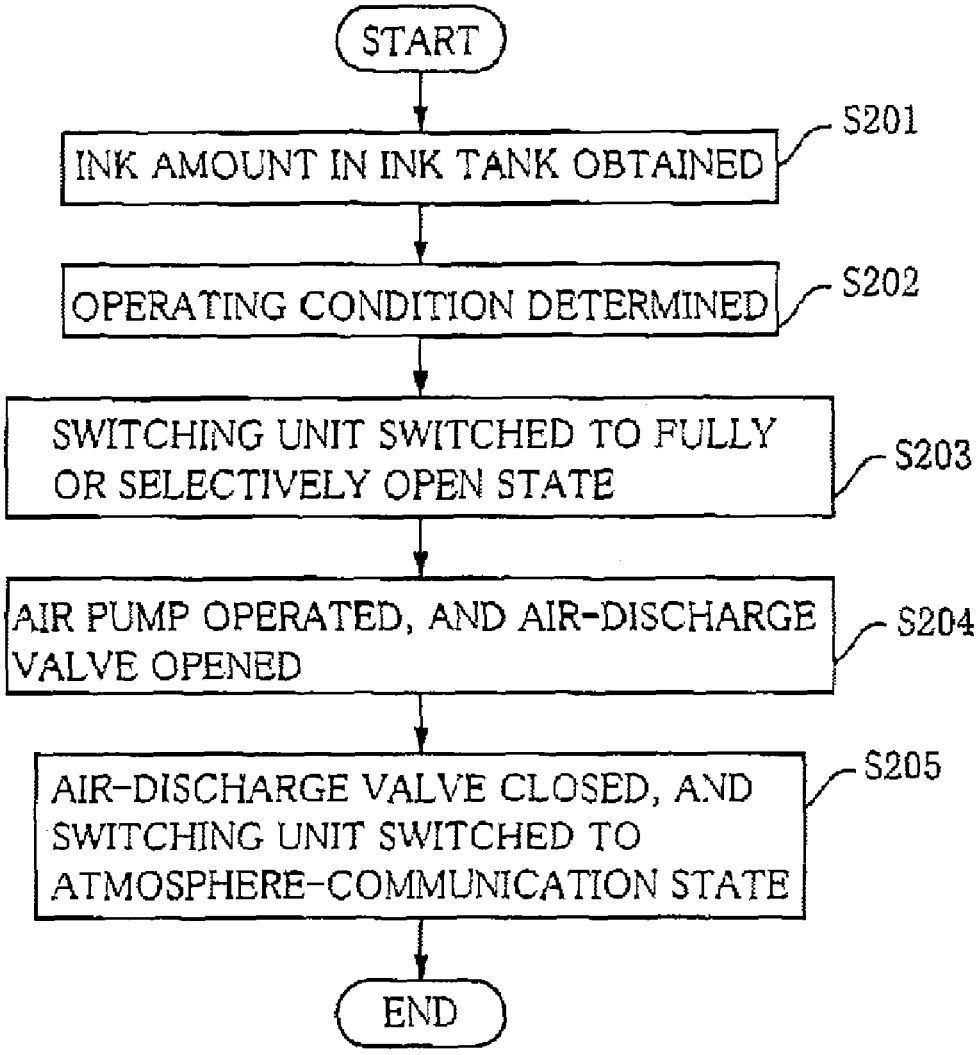
FIG. 14 is a flow chart representing an air-discharging-operation control routine as portion of the main control of FIG. 13.

The control device 383 has the same construction as that of the control device 83, shown in FIG. 11, and is operated according to the same control programs as those shown in FIGS. 13 and 14, and accordingly the description thereof is omitted.

In the third embodiment, the switching unit 48 may be switched to its full or selective atmosphere-communication state so that the ink tank(s) 45 is or are communicated with the atmosphere. Alternatively, the ink-jet printer 301 may be operated such that the switching unit 48 is switched to its fully or selectively open state and simultaneously an air pressure in the air tank 46 is made equal to the atmospheric pressure, so that the air pressure(s) in the ink tank(s) 45 is or are made equal to the atmospheric pressure. To this end, the atmosphere-communication air valve 349 is selectively placed, based on a command supplied from the control device 383, in an atmosphere-communication state thereof in which the air valve 349 allows the air tank 46 to communicate with the atmosphere, and a non-communication state thereof in which the air valve 349 does not allow the air tank 46 to communicate with the atmosphere. However, the air tank 46 may be constructed such that as time elapses after the air discharging operation, the air pressure in the air tank 46 naturally or gradually lowers to the atmospheric pressure. In each of the latter two cases, since the switching unit 48 need not be switched to the full or selective atmosphere-communication state, the arrangement of the switching unit 48 can be simplified, and the ink tanks 45 can be easily communicated with the atmosphere.

The upper and lower portions of the flow-passage member 48*b* of the switching valve 48 may be replaced with two separate members, i.e., an upper flow-passage member and a lower flow-passage member that can be rotated relative to each other while they are air-tightly separated from each other. In this case, in the state in which the upper flow-passage member is placed in the fully or selectively open state thereof, the lower flow-passage member may be placed in the fully or selectively atmosphere-communication state, so as to allow the air tank(s) 46 to communicate with the atmosphere. Thus, the atmosphere-communication air valve 349 may be omitted.

As is apparent from the foregoing description of the ink-jet printer 301 as the third embodiment, the operating-condition determining portion 83*d* determines, based on the air amount(s) V in the ink supply tube(s) 65 and the ink inflow passage(s) 61, calculated by the air-amount calculating portion 83*c*, the respective operating conditions of the air pump 47, the switching unit 48, and the air-discharge valve(s) 49, for the air discharging operation. Therefore, when the air discharging operation is carried out, substantially no ink is consumed uselessly, while the ink-ejecting performance of each ink-jet recording head 1 is maintained.

In the third embodiment, the ink-jet printer 301 starts the air discharging operation when it receives the air-discharging-operation starting command inputted by the user into the control device 383, or when the predetermined regular time interval has elapsed since the last air discharging operation. However, the ink-jet printer 301 may be modified, like the second embodiment, such that first the time t1 of growth of the air in the ink supply tube 65 and the ink inflow passage 61 is calculated and, when the calculated air growth time t1 has elapsed, the air discharging operation is carried out.

Figure 18:
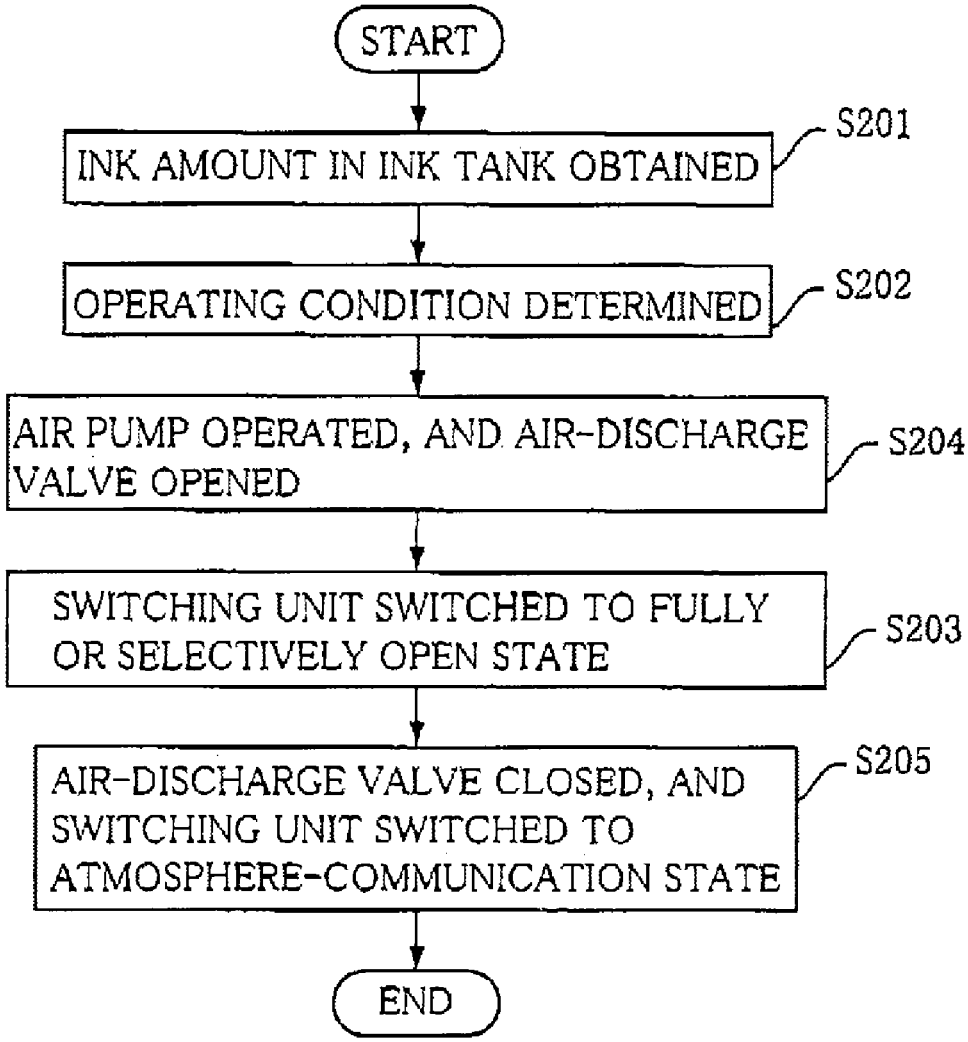
FIG. 18 is a flow chart corresponding to FIG. 14 and showing another air-discharging-operation control routine of another main control program according to which another control device of another ink-jet printer as a fourth embodiment of the present invention controls an air discharging operation of the ink jet printer.

FIG. 18 shows a flow chart corresponding to FIG. 14 and representing another air-discharging-operation control routine of another main control program according to which another control device of another ink-jet printer as a fourth embodiment of the present invention controls an air discharging operation of the ink-jet printer. The ink-jet printer as the fourth embodiment has the same hardware construction as that of the ink-jet printer as the third embodiment shown in FIG. 17. The flow chart of FIG. 18 differs from the flow chart of FIG. 14, only in that in FIG. 18, Step S203 follows Step S204. At Step S204 of FIG. 18, in a state in which the switching unit 48 is placed in the closed state thereof, the appropriate air-discharge valve(s) 49 is or are opened, and the air pump 47 is operated according to the operating condition determined at Step S202, so that an air pressure in the air tank 46 is increased up to a value assuring that the appropriate purging pressure E corresponding to the calculated air volume V is applied to the appropriate ink tank(s) 45 when the switching unit 48 is placed in the fully or selectively open state thereof. When the operation of the air pump 47 ends, Step S204 is followed by Step S203 to place the switching unit 48 in the fully or selectively open state thereof, so that the air pressure(s) in the ink tank(s) 45 is or are increased up to the appropriate purging pressure E and accordingly the air volume V is discharged from the ink-jet head(s) 1 into the outside space through the air-discharge passage(s) 64 thereof.

While the present invention has been described in its preferred embodiments, it is to be understood that the present invention may be embodied in different manners.

For example, in the first embodiment, the air-discharging-operation starting portion 83*a* starts the air discharging operation either when the ink-jet printer 101 receives the air-discharging-operation starting command from the user, or when the predetermined regular time interval has elapsed since the last air discharging operation. However, the operation starting portion 83*a* may be modified such that it starts the air discharging operation only when the ink-jet printer 101 receives the air-discharging-operation starting command from the user, or may be modified such that it starts the air discharging operation only when the predetermined regular time interval has elapsed since the last air discharging operation.

In the first embodiment, the coefficient b is determined based on the material of each ink supply tube 65; the thickness of the wall of the each ink supply tube 65; the area of the cross section of the inner space of the each ink supply tube 65; and the temperature and humidity of the ambient air. However, the coefficient b may be determined based on at least one of (a) the material of each ink supply tube 65; (b) the thickness of the wall of the each ink supply tube 65; (c) the area of the cross section of the inner space of the each ink supply tube 65; (d) the temperature of the ambient air; and (e) the humidity of the ambient air.

In the first embodiment, the air-amount calculating portion 83*b* corrects the coefficient b based on the temperature and humidity of the ambient air detected by the temperature-and-humidity sensor 90. However, the air-amount calculating portion 83*b* may be modified such that it does not correct the coefficient b.

In the first embodiment, the single switching unit 48 is used commonly for the plurality of ink-jet recording heads 1. However, the ink-jet printer 101 may be modified such that it employs a plurality of switching units 48 for the plurality of ink-jet recording heads 1, respectively.

In each of the first and second embodiments, the control device 83, 283 includes the ink-amount obtaining portion 83*c* that obtains the amount(s) of the ink(s) present in the ink tank(s) 45, and the operating-condition determining portion 83*d*, 283*d* determines, based on the ink amount(s) obtained by the ink-amount obtaining portion 83*c*, the operating conditions of the air supplying device for the air discharging operation. However, the control device 83, 283 may be modified such that it does not include the ink-amount obtaining portion 83*c*. In this case, the operating-condition determining portion 83*d*, 283*d* determines, without using the ink amount(s) in the ink tank(s) 45, the operating conditions of the air supplying device.

In the second embodiment, the air-growth-time calculating portion 283*a* calculates, as the air growth time t1, the time period, measured from the last air discharging operation (i.e., an initial time, t=0), during which the amount of air present in the ink supply tube 65 and the ink inflow passage 61 corresponding to each ink-jet recording head 1 grows or increases up to the maximum permissible amount $V_0$ at which the each head 1 can exhibit its adequate ink-ejecting performance. However, the air-growth-time calculating portion 283*a* may be modified such that it calculates, as the air growth time t1, a time period, measured from the last air discharging operation, during which the amount of air increases up to an amount smaller than the maximum permissible amount $V_0$ by a predetermined amount.

In the third embodiment, the operating-condition determining portion 83*d* may determine the operating condition of only the air-discharge valve(s) 49, e.g., only a time period T in which the air-discharge valve(s) 49 is or are opened. In the case where the air pump 47 is so operated as to keep the air pressure in the air tank 46, to a predetermined value, the time period T can be selected at a value assuring that the calculated air amount V can be discharged into the outer space via the air-discharge passage(s) 64 opened by the air-discharge valve(s) 49.

It is to be understood that the present invention may be embodied with other changes and improvements that may occur to a person skilled in the art, without departing from the spirit and scope of the invention defined in the claims.

What is claimed is:

1. An ink-jet printer, comprising:

an ink-jet recording head having (a) an ink inflow passage including an ink inlet into which an ink inflows, and (b) an air-discharge passage which allows the ink inflow passage to communicate with an atmosphere;

an air-discharge valve which selectively opens and closes the air-discharge passage;

an ink tank which stores the ink and which has (c) an ink outlet from which the ink outflows and (d) an air inlet into which an air inflows;

a first connector having an ink supply passage which communicates, at one end thereof, with the ink outlet of the ink tank and communicates, at an other end thereof, with the ink inlet of the ink-jet recording head;

an air supplying device which supplies the air to the ink tank via the air inlet thereof;

an obtaining portion which obtains one of (e) an elapsed time, t, from a reference time and (f) a volume, V, of an air present in the ink supply passage and the ink inflow passage at the elapsed time t, based on an other of the elapsed time t and the volume V of the air, and a following relationship:

$$V=a\cdot e^{bt}$$

where a and b are coefficients, and e is a base of a natural logarithm; and a control portion which controls, based on the obtained one of the elapsed time t and the volume V of the air, an operation of at least one of the air supplying device and the air-discharge valve.

2. The ink-jet printer according to claim 1, wherein the ink-jet recording head additionally has a plurality of pressure chambers; a plurality of nozzles; and a plurality of individual ink flow passages each of which communicates, at one end thereof with the ink inflow passage and communicates, at an other end thereof, with a corresponding one of the nozzles via a corresponding one of the pressure chambers.

3. The ink-jet printer according to claim 1, wherein the reference time is a time when the control portion controls, for a last time, the operation of said at least one of the air supplying device and the air-discharge valve, so that the air in the ink supply passage and the ink inflow passage is discharged through the air-discharge passage.

4. The ink-jet printer according to claim 1, wherein the control portion operates the air-discharge valve to close the air-discharge passage and, in a state in which the air-discharge valve closes the air-discharge passage, the control portion controls, based on the obtained one of the elapsed time t and the volume V of the air, the operation of the air supplying device, so as to regulate a pressure of the air in the ink tank to a value that is to discharge the air in the ink supply passage and the ink inflow passage when the air-discharge passage is opened by the air-discharge valve.

5. The ink-jet printer according to claim 1, wherein the control portion operates the air-discharge valve to open the air-discharge passage and, in a state in which the air-discharge valve opens the air-discharge passage, the control portion controls, based on the obtained one of the elapsed time t and the volume V of the air, the operation of the air supplying device, so as to regulate an amount of the air supplied to the ink tank, to a value that is to discharge the air in the ink supply passage and the ink inflow passage through the air-discharge passage opened by the air-discharge valve.

6. The ink-jet printer according to claim 1, wherein the obtaining portion obtains the volume V of the air based on the elapsed time t, wherein the ink-jet printer further comprises an operating-condition determining portion which determines, based on the obtained air volume V, an operating condition of said at least one of the air supplying device and the air-discharge valve to regulate a pressure of the air in the ink tank such that the greater the obtained air volume V is, the higher the pressure is, and wherein the control portion controls, based on the operating condition determined by the operating-condition determining portion, the operation of said at least one of the air supplying device and the air-discharge valve.

7. The ink-jet printer according to claim 6, wherein the operating-condition determining portion determines, based on the obtained air volume V, the operating condition of the air supplying device to regulate the pressure of the air in the ink tank such that the greater the obtained air volume V is, the higher the pressure is, and wherein the control portion controls, based on the operating condition determined by the operating-condition determining portion, the operation of the air supplying device.

8. The ink-jet printer according to claim 6, wherein at a current time when the time t has elapsed from the reference time when the control portion controlled, for a last time, the operation of said at least one of the air supplying device and the air-discharge valve, so that the volume V of the air at the elapsed time t for the last time is discharged through the air-discharge passage, the obtaining portion obtains the volume V of the air based on the elapsed time t, and the control portion controls, for the current time, the operation of said at least one of the air supplying device and the air-discharge valve, so that the volume V of the air at the elapsed time t for the current time is discharged through the air-discharge passage.

9. The ink-jet printer according to claim 6, further comprising an input device which is operable by a user to input an air-discharge command to discharge the air present in the ink supply passage and the ink inflow passage, through the air-discharge passage, wherein the obtaining portion obtains the volume V of the air based on the elapsed time t when the user inputs the air-discharge command through the input device.

10. The ink-jet printer according to claim 1, wherein the obtaining portion obtains the elapsed time t based on the volume V of the air, and wherein the control portion controls, based on the obtained elapsed time t, the operation of said at least one of the air supplying device and the air-discharge valve.

11. The ink-jet printer according to claim 10, wherein the control portion controls, based on the obtained elapsed time t, the operation of the air supplying device.

12. The ink-jet printer according to claim 1, wherein the obtaining portion determines the coefficient b based on at least one of (a) a material of the first connector, (b) a thickness of the first connector having an inner space defining the ink supply passage, (c) a cross-sectional area of the ink supply passage, taken along a plane perpendicular to a direction in which the ink flows in the ink supply passage, (d) a temperature of an ambient air around the ink-jet printer, and (e) a humidity of an ambient air around the ink-jet printer.

13. The ink-jet printer according to claim 12, further comprising a detector which detects at least one of the temperature and the humidity of the ambient air, wherein the obtaining portion determines the coefficient b based on said at least one of the temperature and the humidity detected by the detector.

14. The ink-jet printer according to claim 1, comprising a plurality of said ink-jet recording heads, a plurality of said ink tanks having the respective air inlets, and a plurality of said first connectors having the respective ink supply passages, wherein the ink-jet printer further comprises at least one second connector having at least one air supply passage which communicates, at at least one first end thereof, with at least one air outlet of the air supplying device and communicates, at a plurality of second ends thereof, with the respective air inlets of the ink tanks; and an atmosphere communicating device which allows each one of the ink tanks to communicate with an atmosphere so that the pressure of the air in said each ink tank becomes equal to an atmospheric pressure, wherein the air supplying device includes:

an air pump which supplies the air to said each ink tank; and at least one air valve which is provided in said at least one air supply passage and which is selectively placed in an open state thereof in which said at least one air valve allows the air pump and at least one of the ink tanks to communicate with each other, and a closed state thereof in which said at least one air valve does not allow the air pump and any of the ink tanks to communicate with each other.

15. The ink jet printer according to claim 14, wherein the atmosphere communicating device places said at least one air valve in the open state thereof and, in a state in which said at least one air valve is placed in the open state thereof allows said at leas one of the ink tanks to communicate with the atmosphere.

16. The ink-jet printer according to claim 14, wherein said at least one air valve is selectively placed in an atmosphere-communication state in which said at least one air valve allows at least one of the ink tanks to communicate with the atmosphere, and a non-communication state in which said at least one air valve does not allow any of the ink tanks to communicate with the atmosphere, and wherein the atmosphere communicating device places said at least one air valve in the atmosphere-communication state thereof.

17. The ink-jet printer according to claim 1, comprising a plurality of said ink-jet recording heads, a plurality of said ink tanks having the respective air inlets, and a plurality of said first connectors having the respective ink supply passages, wherein the ink-jet printer further comprises at least one second connector having at least one air supply passage which communicates, at at least one first end thereof with at least one air outlet of the air supplying device and communicates, at a plurality of second ends thereof with the respective air inlets of the ink tanks; and an atmosphere communicating device which allows each one of the ink tanks to communicate with an atmosphere so that the pressure of the air in said each ink tank becomes equal to an atmospheric pressure, wherein the air supplying device includes:

an air tank which stores a pressurized air;

an air pump which supplies the pressurized air to the air tank; and at least one air valve which is provided in said at least one air supply passage and which is selectively placed in an open state thereof in which said at least one air valve allows the air tank and at least one of the ink tanks to communicate with each other, and a closed state thereof in which said at least one air valve does not allow the air tank and any of the ink tanks to communicate with each other.

18. The ink-jet printer according to claim 1, wherein the control portion controls, based on the obtained one of the elapsed time t and the volume V of the air, the operation of the at least one of the air supplying device and the air-discharge valve, so that the air in the ink supply passage and the ink inflow passage is discharged through the air-discharge passage opened by the air-discharge valve.

19. The ink-jet printer according to claim 18, wherein the control portion controls, based on the obtained one of the elapsed time t and the volume V of the air, the operation of the at least one of the air supplying device and the air-discharge valve, so that in addition to the air, a deteriorated ink in the ink supply passage and the ink inflow passage is discharged through the air-discharge passage opened by the air-discharge valve.

20. A method of controlling an ink-jet printer including an ink-jet recording head having (a) an ink inflow passage including an ink inlet into which an ink inflows, and (b) an air-discharge passage which allows the ink inflow passage to communicate with an atmosphere; an air-discharge valve which selectively opens and closes the air-discharge passage; an ink tank which stores the ink and which has (c) an ink outlet from which the ink outflows and (d) an air inlet into which an air inflows; a connector having an ink supply passage which communicates, at one end thereof with the ink outlet of the ink tank and communicates, at an other end thereof, with the ink inlet of the ink-jet recording head; and an air supplying device which supplies the air to the ink tank via the air inlet thereof, the method comprising obtaining one of (e) an elapsed time, t, from a reference time and (D a volume, V, of an air present in the ink supply passage and the ink inflow passage at the elapsed time t, based on an other of the elapsed time t and the volume V of the air, and a following relationship:

$$V=a\cdot e^{bt}$$

where a and b are coefficients, and e is a base of a natural logarithm, and controlling, based on the obtained one of the elapsed time t and the volume V of the air, an operation of at least one of the air supplying device and the air-discharge valve.

21. The method according to claim 20, wherein said obtaining comprises obtaining the volume V of the air based on the elapsed time t, wherein the method further comprises determining, based on the obtained air volume V, an operating condition of said at least one of the air supplying device and the air-discharge valve to regulate a pressure of the air in the ink tank such that the greater the obtained air volume V is, the higher the pressure is, and wherein said controlling comprises controlling, based on the determined operating condition, the operation of said at least one of the air supplying device and the air-discharge valve.

22. The method according to claim 20, wherein said obtaining comprises obtaining the elapsed time t based on the volume V of the air, and wherein said controlling comprises controlling, based on the obtained elapsed time t, the operation of said at least one of the air supplying device and the air-discharge valve.

23. The method according to claim 18, wherein said controlling comprises controlling, based on the obtained one of the elapsed time t and the volume V of the air, the operation of the at least one of the air supplying device and the air-discharge valve, so that the air in the ink supply passage and the ink inflow passage is discharged through the air-discharge passage opened by the air-discharge valve.

24. The method according to claim 23, wherein said controlling comprises controlling, based on the obtained one of the elapsed time t and the volume V of the air, the operation of the at least one of the air supplying device and the air-discharge valve, so that in addition to the air, a deteriorated ink in the ink supply passage and the ink inflow passage is discharged through the air-discharge passage opened by the air-discharge valve.

* * * * *